US008341902B2

(12) United States Patent
Kusuma

(10) Patent No.: US 8,341,902 B2
(45) Date of Patent: Jan. 1, 2013

(54) MULTI-STORY BUILDINGS FROM PREFABRICATED CONCRETE COMPONENTS

(76) Inventor: Trisna Widjaja Kusuma, Jakarta Barat (ID)

( * ) Notice: Subject to any disclaimer, the term of this patent is extended or adjusted under 35 U.S.C. 154(b) by 0 days.

(21) Appl. No.: 13/052,047

(22) Filed: Mar. 19, 2011

(65) Prior Publication Data

US 2011/0225905 A1 Sep. 22, 2011

(30) Foreign Application Priority Data

Mar. 19, 2010 (ID) ..... P00201000223

(51) Int. Cl.

| | |
|---|---|
| ***E04H 1/00*** | (2006.01) |
| ***E04H 14/00*** | (2006.01) |
| ***E04H 3/00*** | (2006.01) |
| ***E04H 5/00*** | (2006.01) |
| ***E04H 6/00*** | (2006.01) |

(52) U.S. Cl. ..... 52/236.3; 52/185; 52/262; 52/252; 52/270; 52/296; 403/170; 403/217

(58) Field of Classification Search ..... 52/183, 52/185, 188, 189, 236.3, 236.6, 236.7, 169.9, 52/296, 299, 252, 262, 270; 403/217–219, 403/169–178

See application file for complete search history.

(56) References Cited

U.S. PATENT DOCUMENTS

| | | | | |
|---|---|---|---|---|
| 1,205,465 | A * | 11/1916 | Maguire et al. | 52/252 |
| 3,136,092 | A * | 6/1964 | Contini | 52/73 |
| 3,495,371 | A * | 2/1970 | Mitchell, Jr. | 52/653.1 |
| 3,594,971 | A * | 7/1971 | Hughes | 52/648.1 |
| 4,328,651 | A * | 5/1982 | Gutierrez | 52/293.1 |
| 4,995,205 | A * | 2/1991 | Bennett | 52/189 |
| 5,359,816 | A * | 11/1994 | Iacouides | 52/274 |
| 6,192,636 | B1 * | 2/2001 | Hayashi et al. | 52/126.7 |
| 7,066,094 | B2 * | 6/2006 | Moutsokapas et al. | 104/124 |
| 8,011,147 | B2 * | 9/2011 | Hanlan | 52/252 |
| 2002/0095888 | A1 * | 7/2002 | Winskye | 52/234 |

FOREIGN PATENT DOCUMENTS

| | | |
|---|---|---|
| WO | WO98/54419 | 12/1998 |
| WO | WO2006/073319 | 7/2006 |
| WO | WO2006/110045 | 10/2006 |
| WO | WO2007/011127 | 1/2007 |
| WO | WO2007/043897 | 4/2007 |

* cited by examiner

*Primary Examiner* — Brian Glessner
*Assistant Examiner* — Brian Mattei
(74) *Attorney, Agent, or Firm* — Intellectual Property Law Group LLP

(57) ABSTRACT

Multi-story buildings assembled from pre-cast concrete components produced in a component factory to form earthquake-resistant buildings with lower cost and faster construction time. The multi-story building structure comprising a plurality of piles and pile caps; prefabricated concrete column components; prefabricated concrete beam components; prefabricated concrete floor components; prefabricated concrete stairs components and prefabricated concrete wall components. Each pile cap unites at least two piles to one column; each column component has a groove on each side of the column component for placement of the corresponding sides of prefabricated wall components; and each beam component comprises grooves on the bottom and top sides of the beam for placement of wall components; and openings are located in the body of the beam. Floor components, stairs components, and wall components are made of concrete that are pre-cast with a predetermined shape, size and strength as described.

17 Claims, 37 Drawing Sheets

FIG. 2A
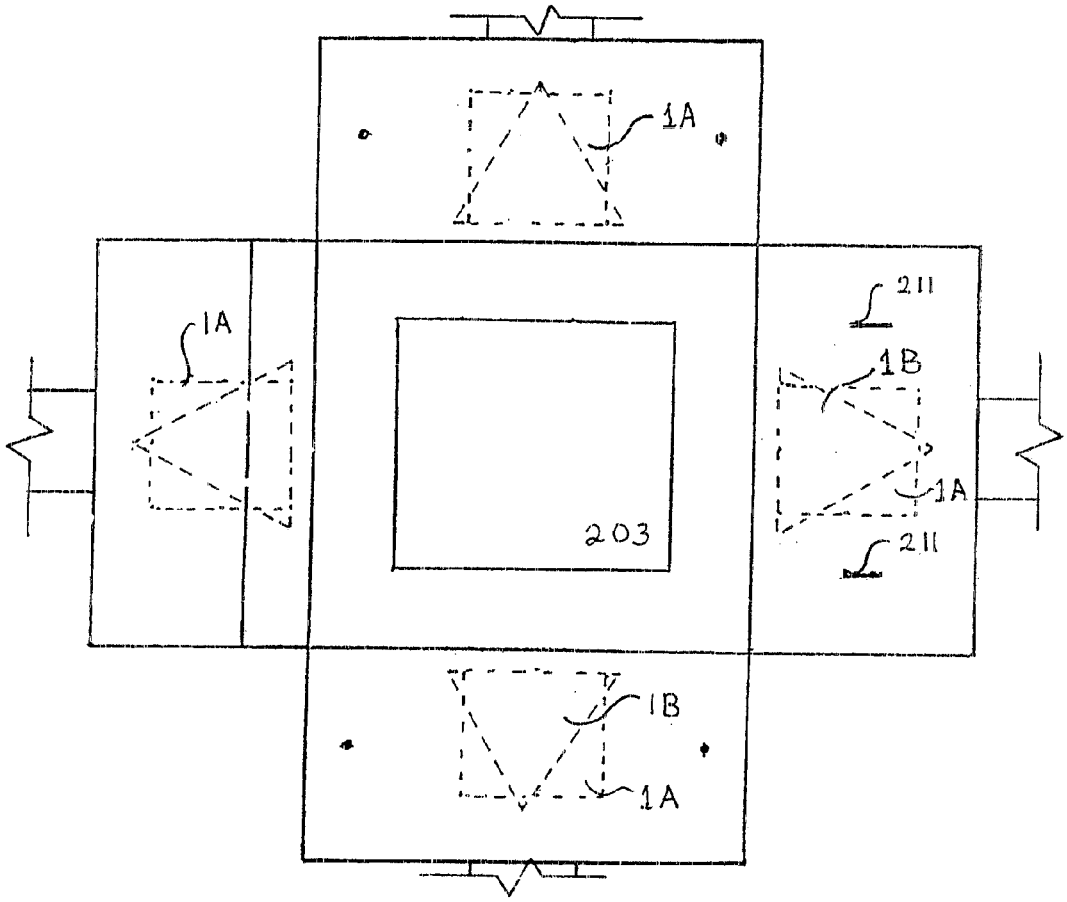
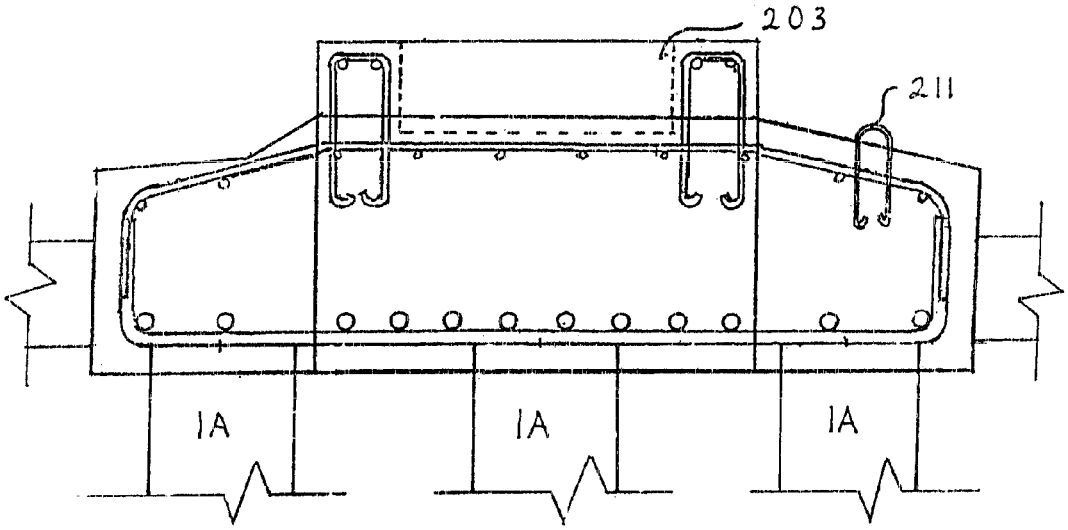
FIG. 2B 1063
1064
1051
1052
1061
1062
2061
2062
3A
a
b
201
202
204
207
208
210

102
1062
1061
1064
1055
2063
1056
38
210
a
b
503
510
204
207
2064
110
202
208

4D
5C
102
711
4A
202
1056
3B
3
5B
floor
corridor
4G
4H
204
510
509
709
7G
7H 701
711H
711V
704
711V
707
711H
320
711
5B
4A
202

710
707
710
707
210
710
707
710
707
710
707
710
710
710
710
711
711
711
711

MULTI-STORY BUILDINGS FROM PREFABRICATED CONCRETE COMPONENTS

CROSS REFERENCE TO RELATED APPLICATION

This application claims priority to and the benefit of Indonesian Patent Application No. P00201000223, filed on Mar. 19, 2010, the entire contents of which are incorporated herein by reference.

BACKGROUND

1. Field of Invention

This invention relates to prefabricated concrete components that are assembled on site to form a multi-story building.

2. Background

The need for multi-story housing units is increasing with population increase. Despite the rapid population increase, land size for housing cannot increase. An alternative housing solution is building multi-story housing units, especially in inner city neighborhoods of a metropolitan district such as Jakarta.

Multi-story building construction technology often uses piles as the foundation to support the building. On top of the piles are then attached the columns and beams to form a building frame. Then walls, floors, partitions and other components can be added as needed.

Concrete columns and beams, are usually cast in concrete on site. Casting concrete on site requires sufficient space on the site, preparation and a good amount of time. Usually, before the columns and beams can be cast, rebars must be arranged and formed to the desired shape and a cast frame is made with the necessary supports below and on each side to keep the concrete from pouring out of the form. After all that is done, concrete can be poured.

Current pre-cast concrete technology exists only for walls and floors. Such pre-cast concrete components can speed up multi-story building construction. Instead of constructing brick walls on each floor, pre-cast wall components can be simply assembled. Floor components are usually pre-cast according to floor size and shape to ease on site assembly by avoiding on site rebar assembly and concrete casting as much as possible.

Several patents have been filed in 1998, 2006 and 2007 in this pre-cast concrete area which include WO98/54419, WO2007/011127, WO2007/043897, WO2006/110045, and WO2006/073319, but none of these patents cover construction of the multi-story building as a whole. They only cover a part or a component of the building, and do not include pre-cast concrete columns and beams.

This invention described below provides for the whole building including columns, beams, floors, walls and stairs, all prefabricated in concrete with predetermined size, strength and form, so that the whole building can be assembled quicker and less expensively with the required size and strength.

SUMMARY

According to an embodiment of the present invention, there is described multi-story buildings and structures comprising precast concrete components. According to an embodiment, there is described a multi-story building comprising a pile foundation; pile caps; columns; beams or girders; floors; stairs; and walls. The structure comprises: every pile cap unites at least two piles to one column; every concrete column component has a groove on each side for placement of wall components; and every beam component includes grooves above and below for placement of wall components as well as holes in the body of the beam for plumbing and electrical installation. The structure further comprises: floor components made of concrete and pre-cast in the predetermined shape and size; wall components made of concrete and pre-cast in the predetermined shape and size; and stairs components made of concrete and pre-cast in the predetermined shape and size such that they can be assembled to form stairs of adjustable height.

According to other embodiments of the invention, the plurality of column components and beam components are made of precast concrete with a predetermined shape, size and strength; and each column component has four column wings to support a plurality of beams on each floor. Further, each column wing comprises a top portion and a longer bottom portion stepped out from the top portion, forming an L-shape. The shorter top portion and long bottom portion each have a number of right-angle steel plates welded to a plurality of rebars before the column component is cast, and each of the plurality of right-angle steel plates has one or more holes for mounting bolts. The longer bottom portion has an anchor hole running through a middle part of it.

In another embodiment of the present invention, the prefabricated components are assembled to form one or more housing units of up to six stories, wherein each housing unit comprises six column components. The prefabricated components are assembled to form a parking garage of up to seven floors in another embodiment of the present invention. The parking garage further having a plurality of ramps assembled with the prefabricated components.

These and other embodiments of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

FIG. 2A shows a top view of a pile cap according to an embodiment of this invention.

FIG. 2B shows the side view of the pile cap according to an embodiment of this invention.

FIG. 6A shows an upper stair beam component placed next to a wall according to an embodiment of this invention.

FIG. 6B shows an upper stair beam component placed away from the wall according to an embodiment of this invention.

FIG. 6D shows a cross-section of a stair tread according to an embodiment of this invention.

FIG. 7O shows a detail view of the vertical cross-section and rebar placement in a wall component according to an embodiment of this invention.

DETAILED DESCRIPTION OF SPECIFIC EMBODIMENTS

Figure 1A:
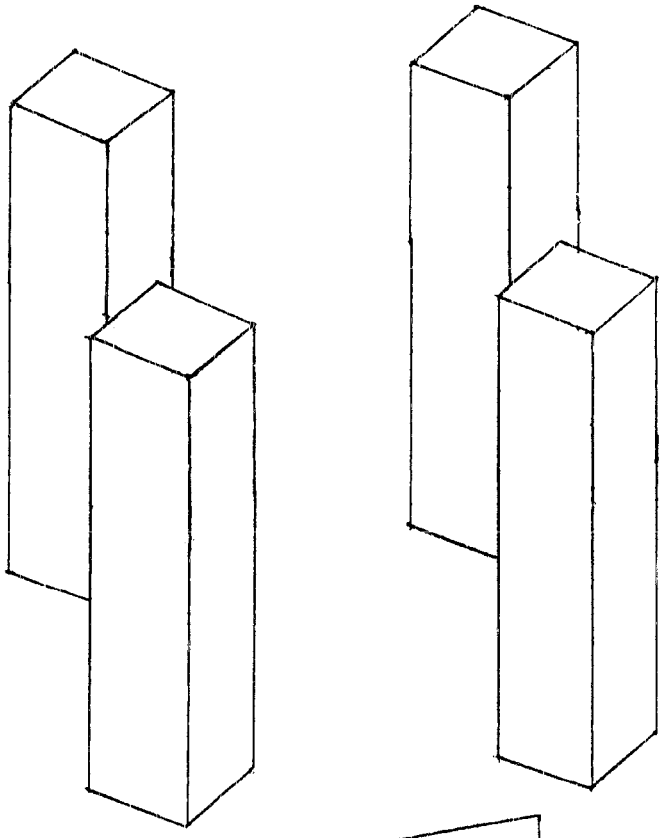
FIGS. 1A and 1B show standard square and triangular pile components that are used in embodiments of the invention.

The description above and below and the drawings of the present document focus on one or more currently preferred embodiments of the present invention and also describe some exemplary optional features and/or alternative embodiments. The description and drawings are for the purpose of illustration and not limitation. Like reference numerals refer to like elements throughout the specification. Those of ordinary skill in the art would recognize variations, modifications, and alternatives. Such variations, modifications, and alternatives are also within the scope of the present invention. Section titles are terse and are for convenience only.

Figure 1B:
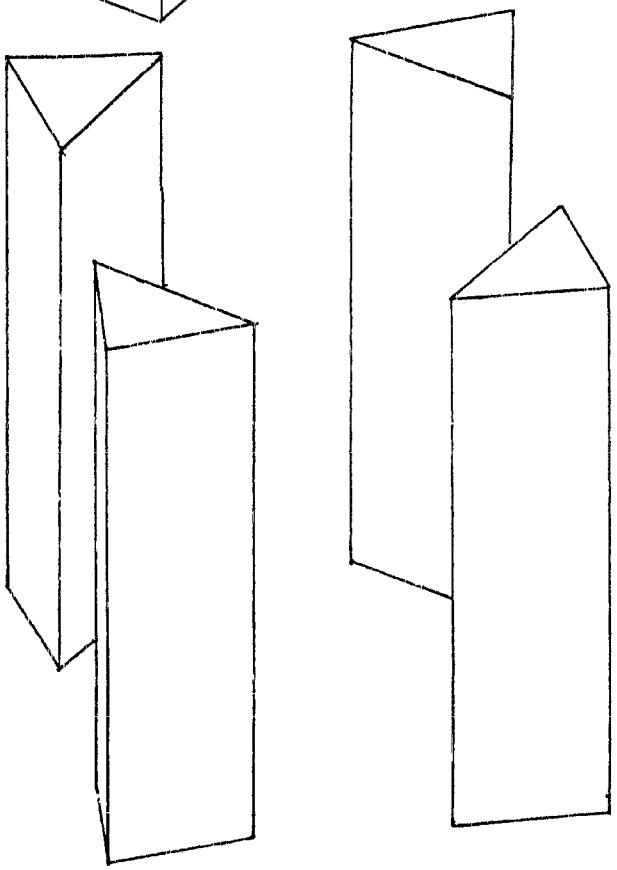

FIG. 1A shows standard square pile foundation components and FIG. 1B standard triangular pile foundation components available in the market that are used in embodiments of the present invention.

Figure 2C:
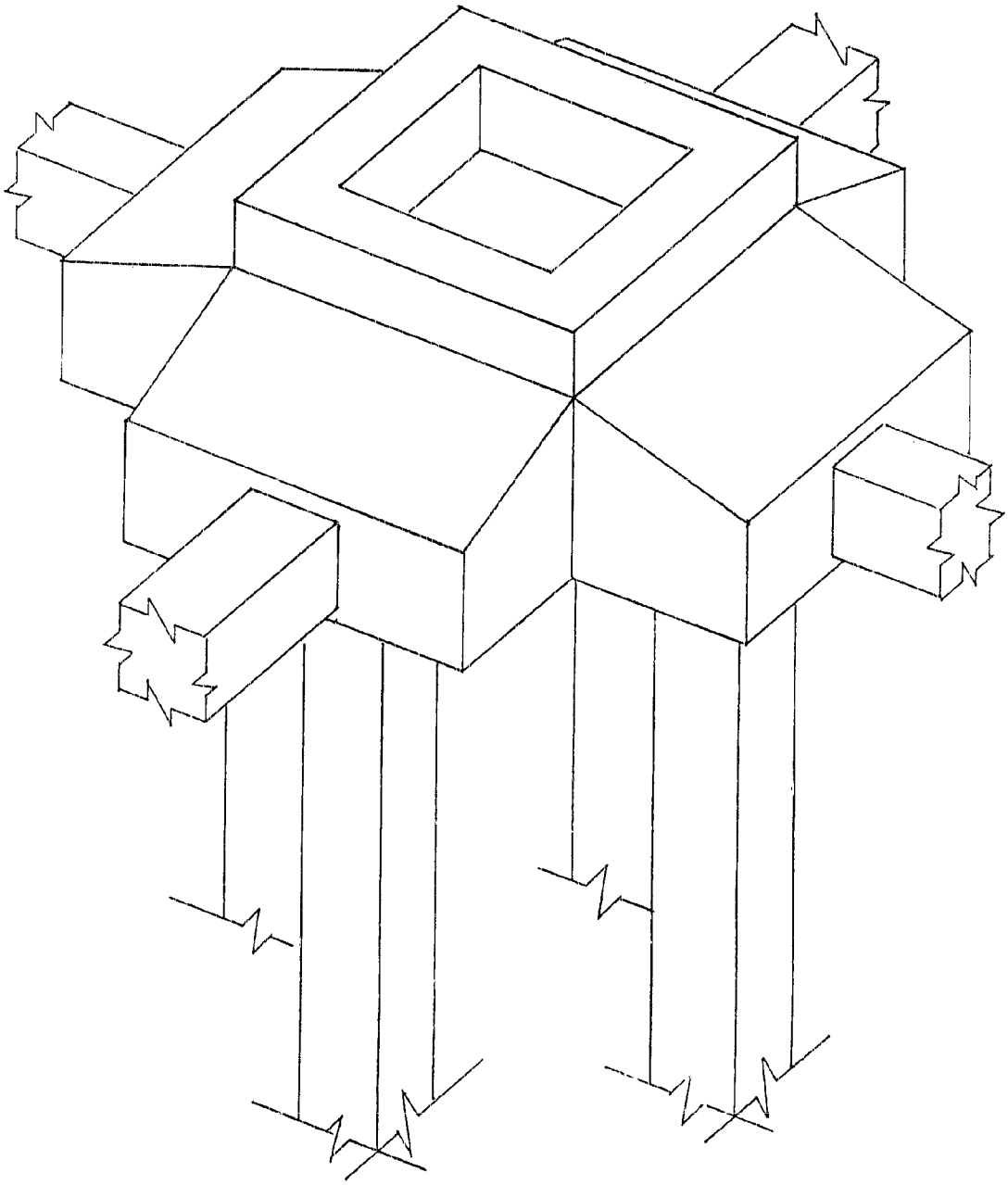
FIG. 2C shows a perspective view of the pile cap and pile foundation according to an embodiment of this invention.

FIG. 2A shows a view from above the pile cap with four piles (as shown in FIG. 1A or 1B). FIG. 2B shows a precast pile cap in cross-section with piles (as in FIG. 1A); and a depression 203 to fit the bottom of a column 303. Concrete grouting is performed after a column is put in the depression 203 so that it cannot be pulled off. Steel anchors 211 are prepared for column erection. FIG. 2C shows a perspective view of the pile foundation and pile cap according to an embodiment of this invention.

Figures 3A, 3B:
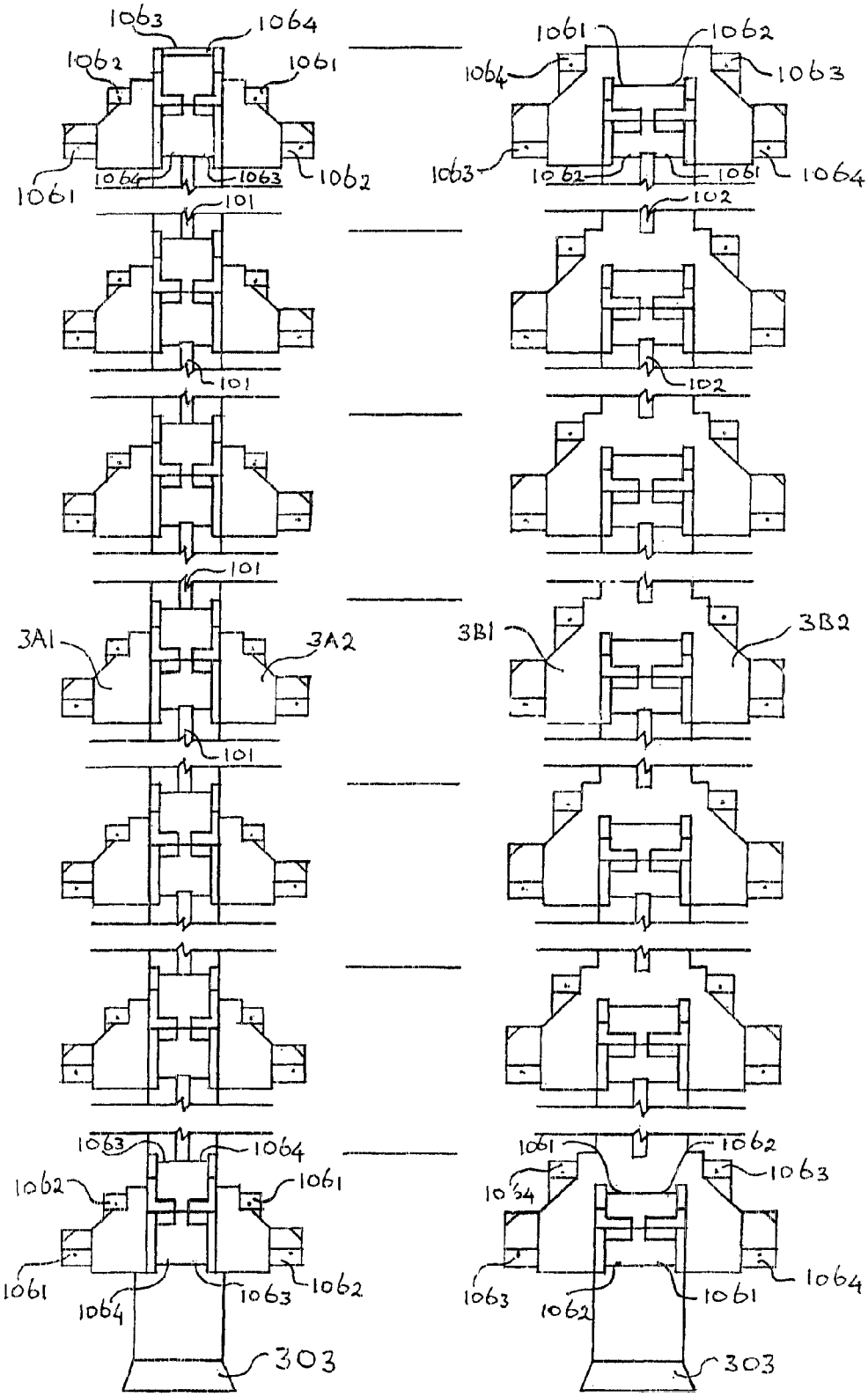
FIGS. 3A and 3B show the front and side views of a column component according to an embodiment of this invention.

FIG. 3A shows a front view of a precast column according to an embodiment of this invention. The column has a groove (101, 102, 103, 104) on each of its sides. Grooves 102, 103, and 104 are not visible in FIG. 3A as they are located on the right, back, and left sides. The sides of wall components will be inserted into the grooves to secure the walls. The grooves are at least 5 cm wide and 1.5 cm deep.

Every column has four wings (3A1, 3A2, 3B1, 3B2) to support beams on each floor. Wings 3B1 and 3B2 are not visible in FIG. 3A since they are on the front and back sides. Construction of these wings will be explained more fully on FIGS. 3C, 3D and 3E.

The bottom end 303 of a column is shaped like a truncated pyramid. This bottom end will be put inside the depression 203 of a pile cap shown in FIG. 2B. After it is placed into the depression on the pile cap and the column has been aligned with other columns, including its height and vertical plumbness, concrete is poured to secure the bottom end of the column to the pile cap permanently. The top end of a column is shaped such that it can be attached to a column extension in this invention.

FIG. 3B shows a side view of a precast column in this invention, showing the same parts as FIG. 3A: including groove 102, wings (3B1 and 3B2), and bottom end 303 of the column.

FIGS. 3A and 3B show that each wing on each floor has four right-angle steel plates (1061, 1062, 1063, 1064) for attaching the column to beams. The connection is made using steel plates that are bolted and then welded to the right-angle steel plates .

Figure 3C:
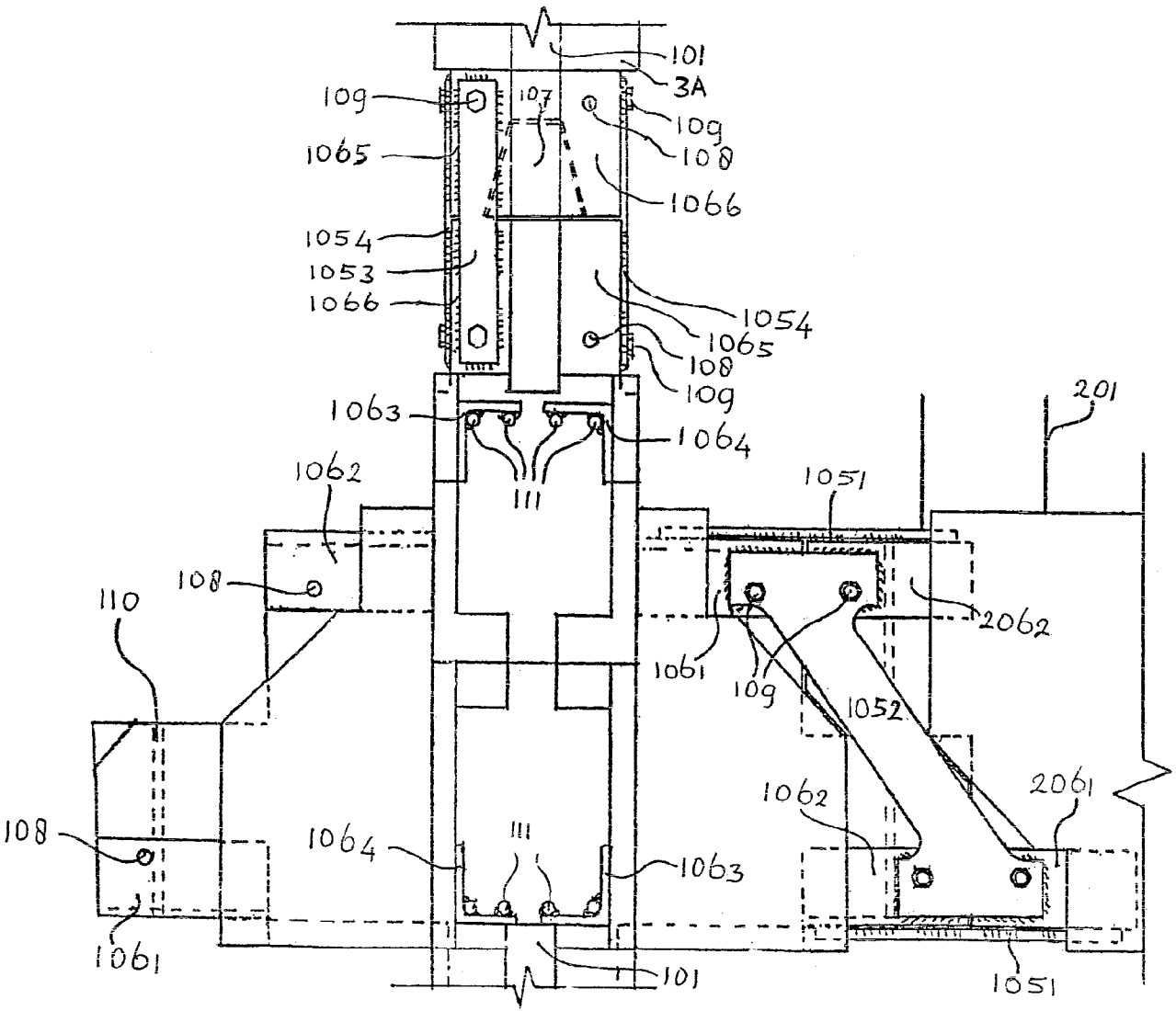
FIG. 3C shows a front view of one wing of the column component at each floor according to an embodiment of this invention.

FIG. 3C shows a front view of the column wings on each floor according to an embodiment of this invention. The top and bottom parts of the wings have right-angle steel plates (1061, 1062, 1063, 1064). The bottom part of the wing is longer than the top part, and also may be referred to as the wing tip. The bottom part of the column wing has a hole 110 in the middle for attaching a beam to the wing using a steel anchor. The top and bottom parts form an L to place a beam. The beam is then joined to the wing using steel plates 1051 on the top and bottom sides of the beam and wing, and using steel plates 1052 on the sides. Both types of plates are bolted 109 on the thread holes 108 and then welded to the right-angle steel plates (1061, 1062, 1063, 1064). The right-angle steel plates (1061, 1062, 1063, and 1064) are welded to the rebar 111 before the column was cast in the factory, to strengthen the connection between column and beam on each column wing.

Figure 3D:
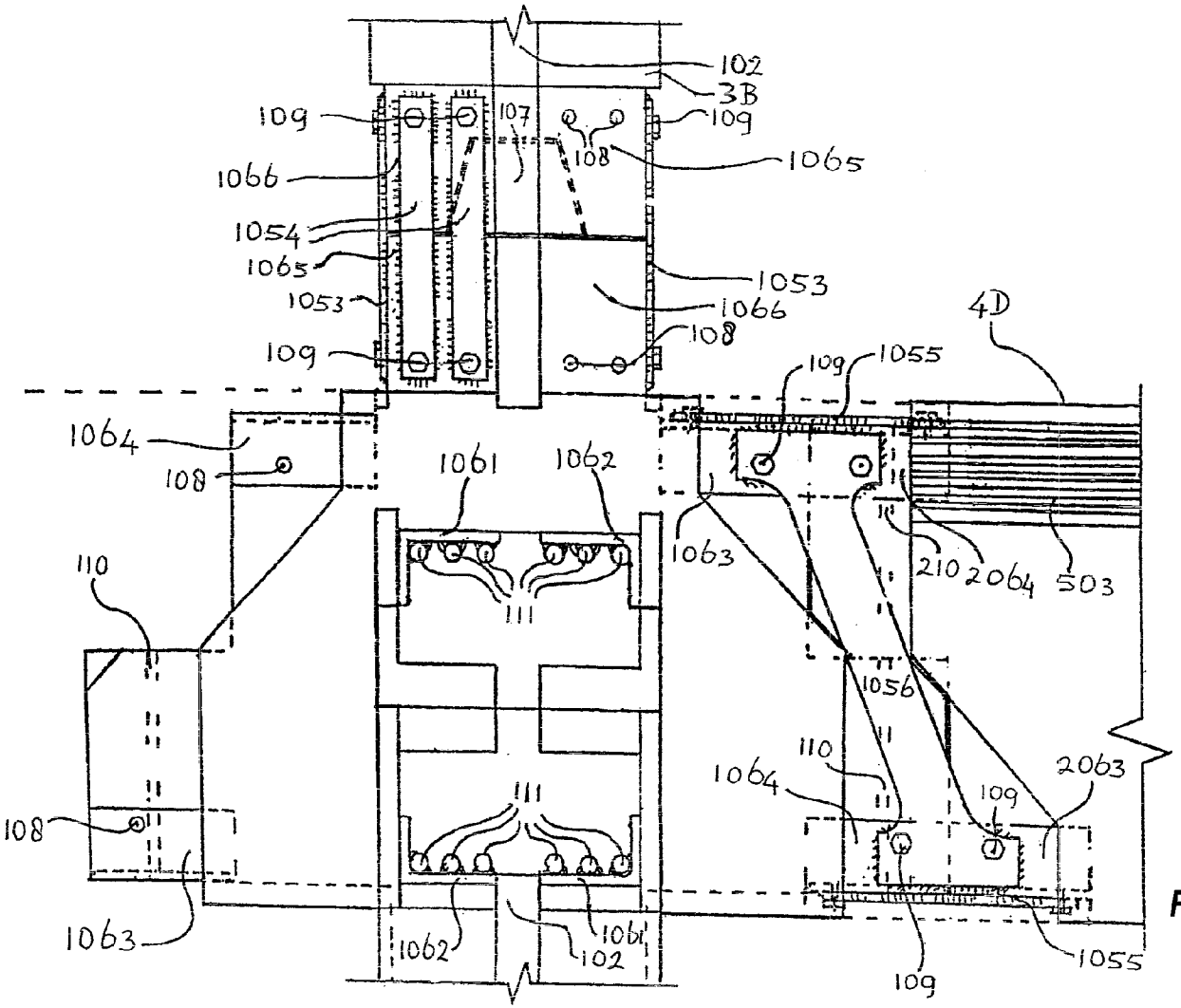
FIG. 3D shows a side view of the connection between a column component and a beam component and the connection between two column components according to an embodiment of this invention.

If the building is being built in stages, for example four floors in a first stage followed by two more floors added on the next stage, it is possible to make columns for four floors only, with a future capability to extend them on top. This extension is shown in FIGS. 3C and 3D, where the top end of the lower column has a pyramid-shaped protrusion 107 in the middle. The bottom of the extension column has the corresponding pyramid-shaped depression to match the protrusion. Each side of the top and bottom ends of the columns to be joined, also has right-angle steel plates (1065, 1066). These right-angle steel plates (1065, 1066) are joined using steel plates (1053, 1054) that are bolted 109 on the thread holes 108 and then welded, according to an embodiment of the present invention.

FIG. 3D shows a side view of the column wings on each floor according to an embodiment of the present invention. The top and bottom parts of the wings have right-angle steel plates (1061, 1062, 1063, 1064). The bottom part of the wing is longer than the top part. The bottom part of the column wing has a hole 110 in the middle for attaching a beam to the wing using a steel anchor. The top and bottom parts form an L to place a beam. The beam is then joined to the wing using steel plates 1055 on the top and bottom sides of the beam and wing, and using steel plates 1056 on the sides. Both types of plates are bolted 109 on the thread holes 108 and then welded to the right-angle steel plates (1061, 1062, 1063, 1064).

Figure 3E:
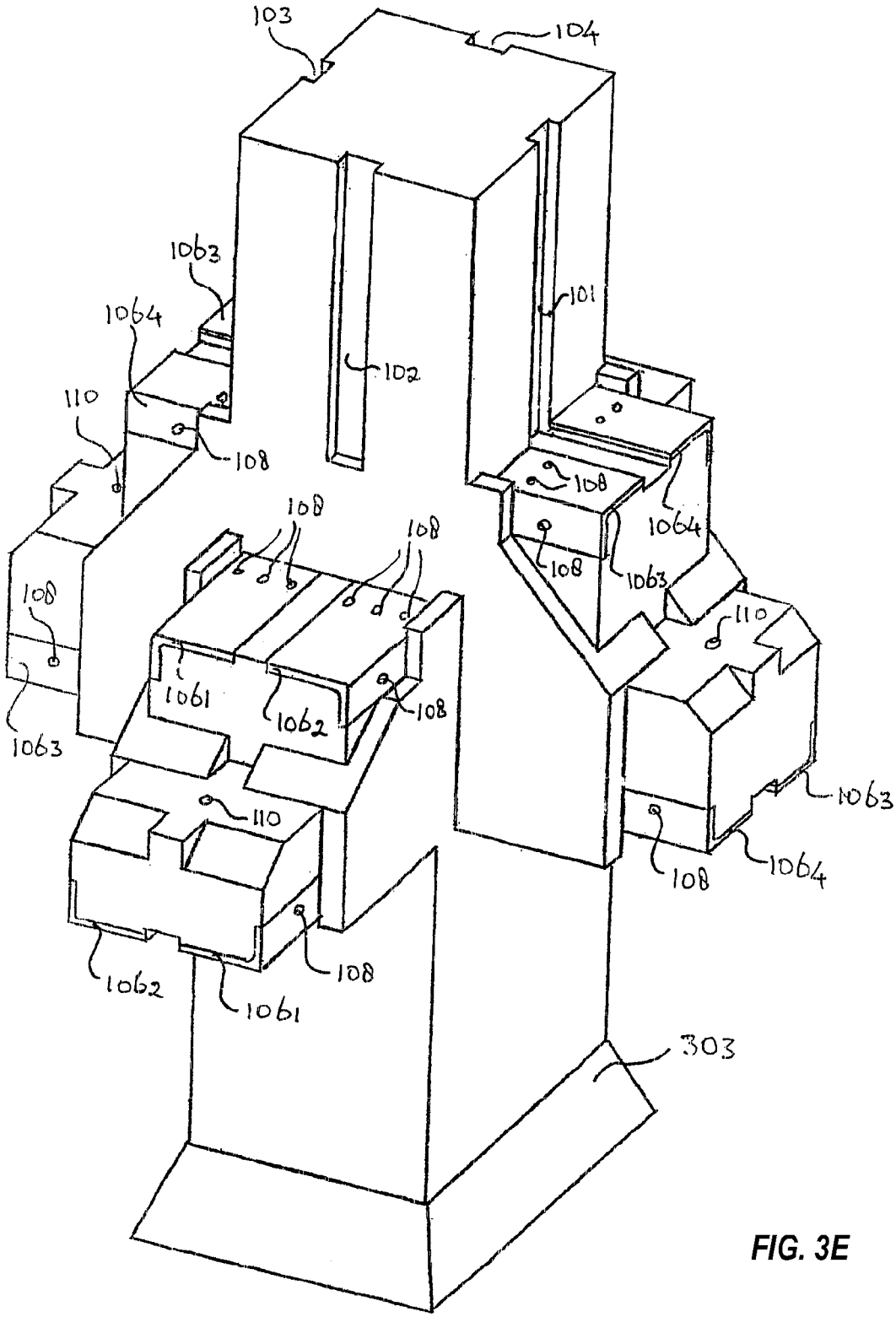
FIG. 3E shows a perspective view of the bottom part of the column component according to an embodiment of this invention.
Figure 3F:
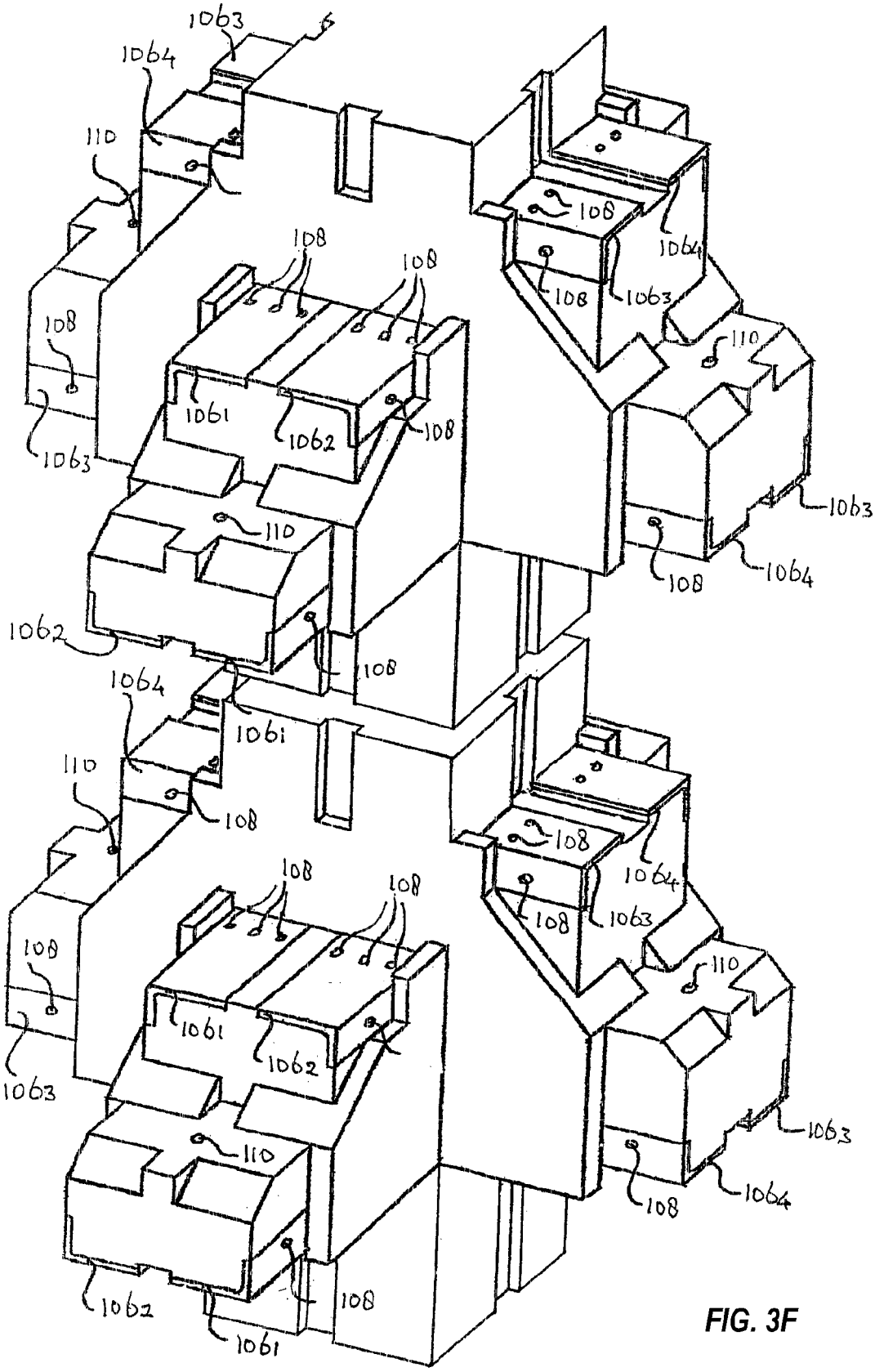
FIG. 3F shows a perspective view of the middle part of the column component according to an embodiment of this invention.
Figure 3G:
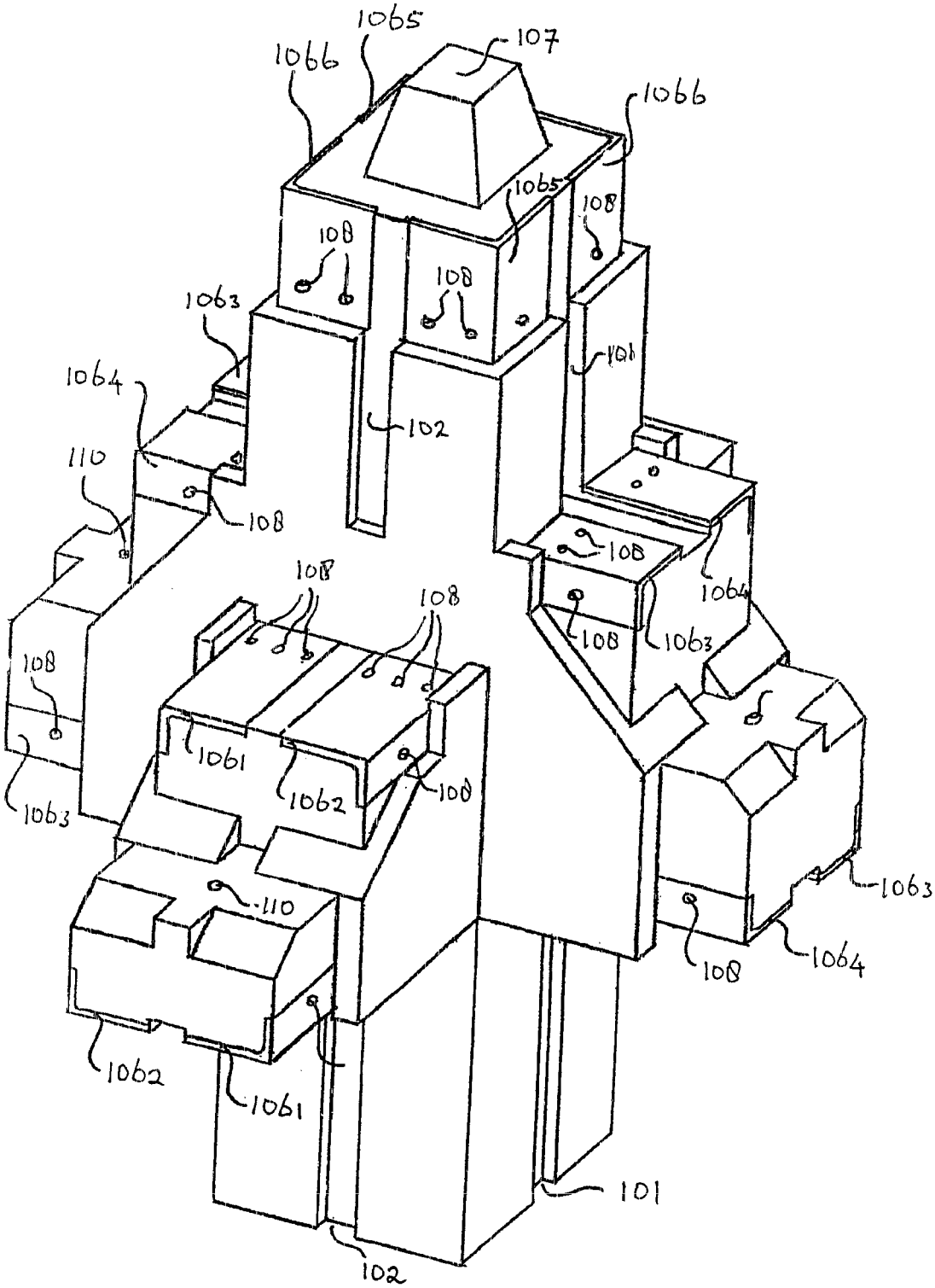
FIG. 3G shows a perspective view of the top part of the column component according to an embodiment of this invention, which can be joined to another column component if more floors need to be added to the building in embodiments of this invention.

FIGS. 3E, 3F and 3G show the column wings on each floor in perspective, with right-angle steel plates (1061, 1062, 1063, 1064), thread holes 108, anchor holes 110 for mounting beams on top of wings, and grooves (101, 102, 103, 104) for mounting wall components. As shown in FIG. 3G, the top end of the column has right-angle steel plates (1065, 1066) and a pyramid-shaped protrusion 107 for connecting to a column extension. As shown in FIG. 3E, the bottom end of the column 303 has a larger pyramid-shape to anchor the column to the pile cap (as shown in FIG. 2B) after it is grouted in concrete. The three dimensional view of the beam in FIG. 4J shows the corresponding right-angle steel plates (2063, 2064), thread holes 208, anchor holes 210, a groove 202 in the bottom for wall component placement, and grooves 503 on the sides to prevent leakage after it is grouted to the floor in this invention.

Figures 4A, 4B, 4C:
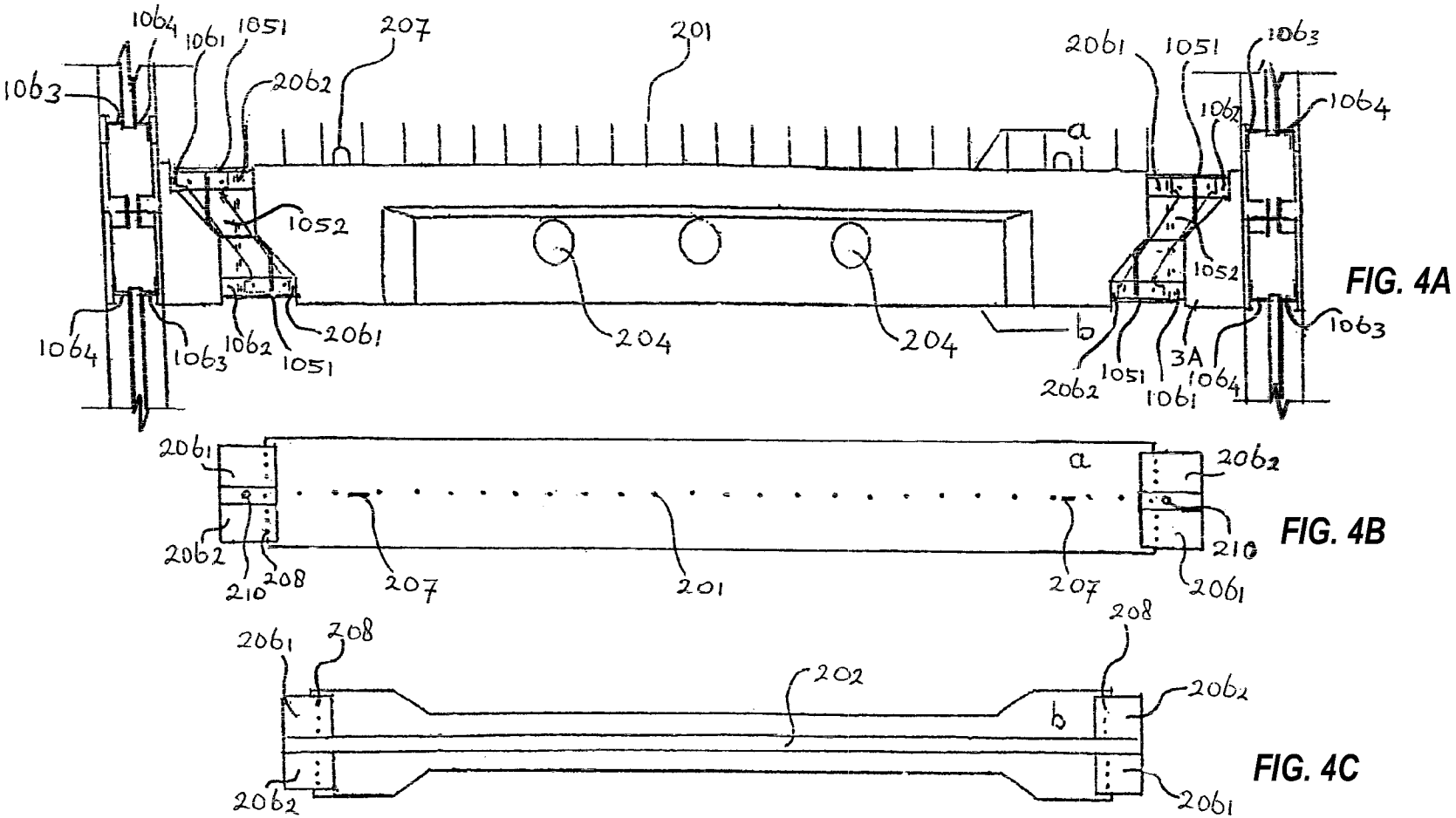
FIG. 4A shows a side view of a floor-supporting beam component attached to column components according to an embodiment of this invention.
FIG. 4B shows the top view of the floor-supporting beam component according to an embodiment of this invention.
FIG. 4C shows the bottom view of the floor-supporting beam component according to an embodiment of this invention.

FIG. 4A shows a precast floor-supporting beam component attached to columns. Floor-supporting beams have steel stakes 201 on top, anchors 207 to lift the beam for installation, holes 204 for plumbing or electrical conduits, and right-angle steel plates (2061, 2062) on each side of both ends. The beam ends are L-shaped and have an anchor hole 210 in the middle. The ends of floor-supporting beams have right-angle steel plates (2061, 2062) that are welded to the rebar 111. The right-angle steel plates have thread holes 208 that are used for attaching steel plates (1051, 1052) before the top 1051, side 1052 and bottom 1051 plates are welded together to the right-angle steel plates (2061, 2062). The anchor holes 210 are used for installing and connecting the beam to column wings. FIG. 4A shows a side view of the beam, showing holes 204 for plumbing and electrical installation. FIG. 4B shows a view of the beam from above, showing right-angle steel plates (2061, 2062), thread holes 208, steel stakes 201 to tie to floor components, and anchors 207 to lift the beam. FIG. 4C shows a view of the beam from below, showing right-angle steel plates (2061, 2062), thread holes 208 and groove 202 matching the top of wall components, according to an embodiment in this invention.

Figures 4D, 4E, 4F:
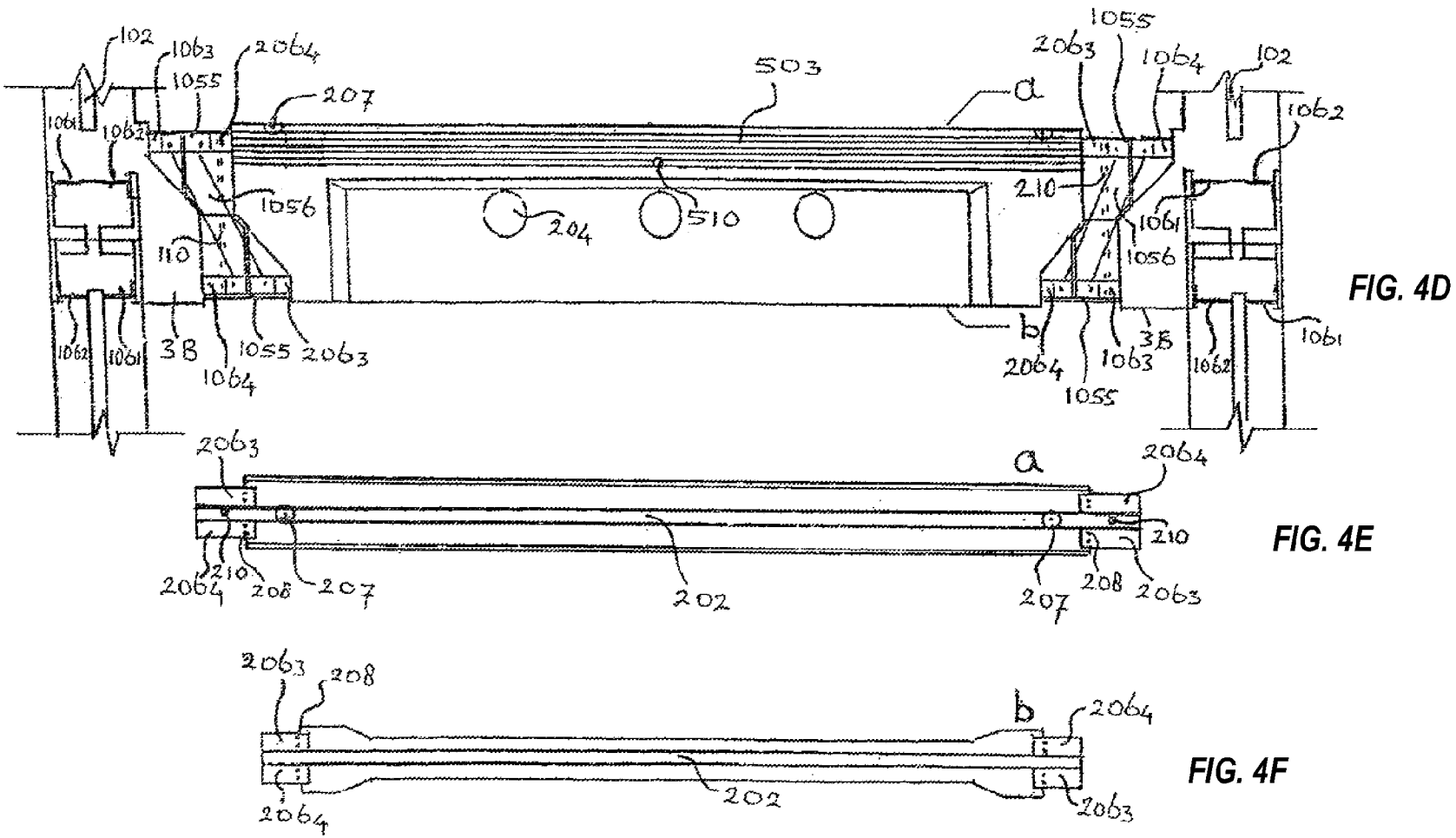
FIG. 4D shows a side view of a wall-supporting beam component attached to column components according to an embodiment of this invention.
FIG. 4E shows the top view of the wall-supporting beam component according to an embodiment of this invention.
FIG. 4F shows the bottom view of the wall-supporting beam component according to an embodiment of this invention.

FIG. 4D shows a precast wall-supporting beam component connected to columns. A wall-supporting beam has a hole 510 to tie to floor components, toothed grooves 503 on the side that will be grouted with the floor, anchors 207 to lift the beam for installation, holes 204 for plumbing and electrical conduits, right-angle steel plates (2063, 2064) that are welded to the rebar 111, and anchor holes 210 for installing and connecting the beam to column wings. The right-angle steel plates have thread holes 208 that are used for bolting steel plates (1055, 1056) before the top 1055, side 1056 and bottom 1055 plates are welded together to the right-angle steel plates (2063, 2064). FIG. 4D shows a side view of the beam showing holes 204 for plumbing and electrical installation. FIG. 4E shows a view of the beam from above, showing the right-angle steel plates (2063, 2064), thread holes 208, anchor holes 210, anchors 207 and a groove 202 matching the bottom part of wall components. FIG. 4F shows a view of the beam from below, showing the right-angle steel plates (2063, 2064), thread holes 208, and groove 202 matching the top of wall components, according to an embodiment in this invention.

Figures 4G, 4H:
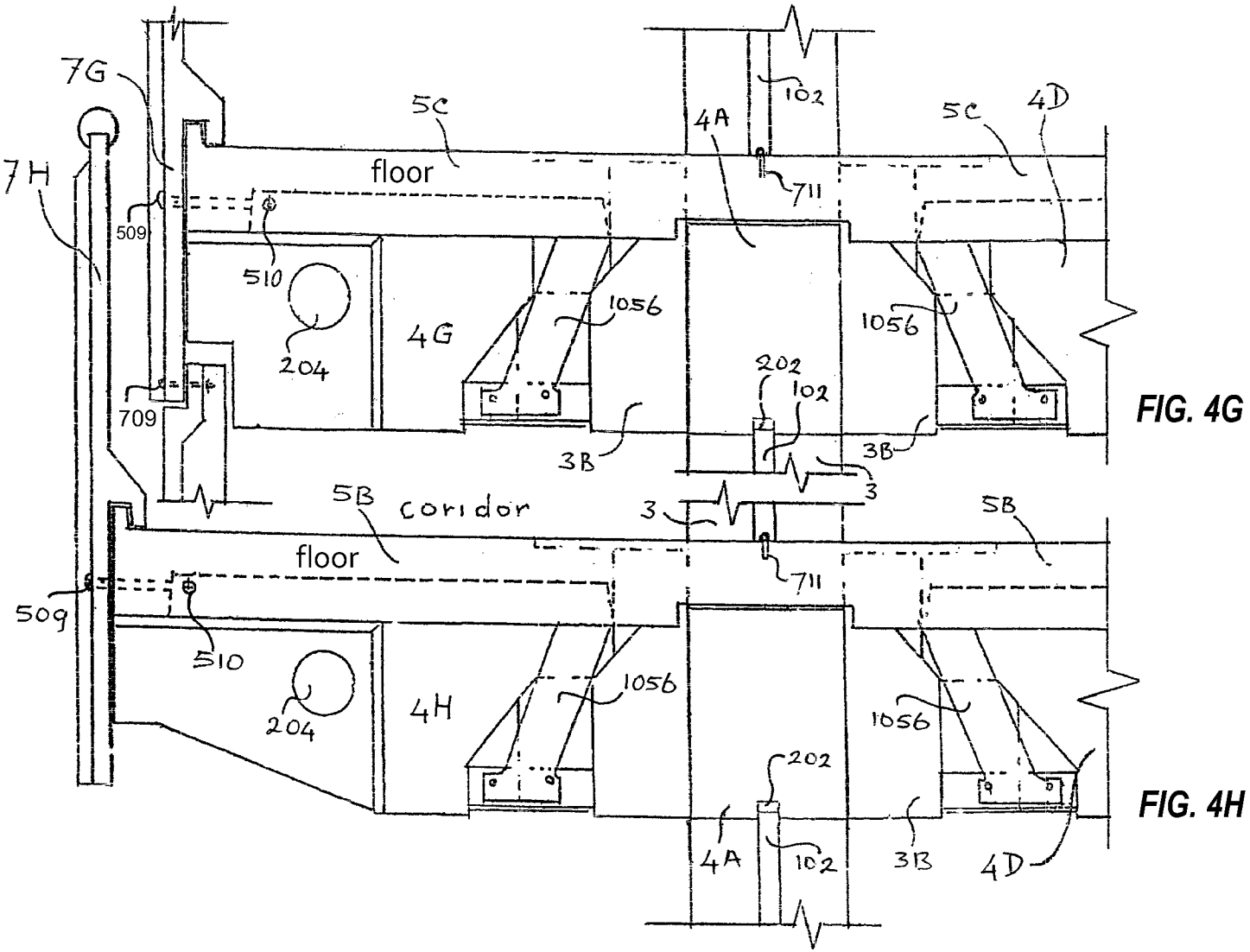
FIG. 4G shows a beam console component supporting an outer wall component according to an embodiment of this invention.
FIG. 4H shows a beam console component supporting a parapet component according to an embodiment of this invention.

FIG. 4G shows a precast beam console connected to a column wing with a steel plate 1056, and the floor end 5C connected to an outer wall 7G with a bolt 509. The beam console has a hole 204 for plumbing and electrical installation, and a hole to bolt it to floor components. FIG. 4H shows a precast beam console connected to a column wing with a steel plate 1056 and the floor end 5B connected to a parapet 7H with a bolt 509, according to an embodiment in this invention.

Figure 4I:
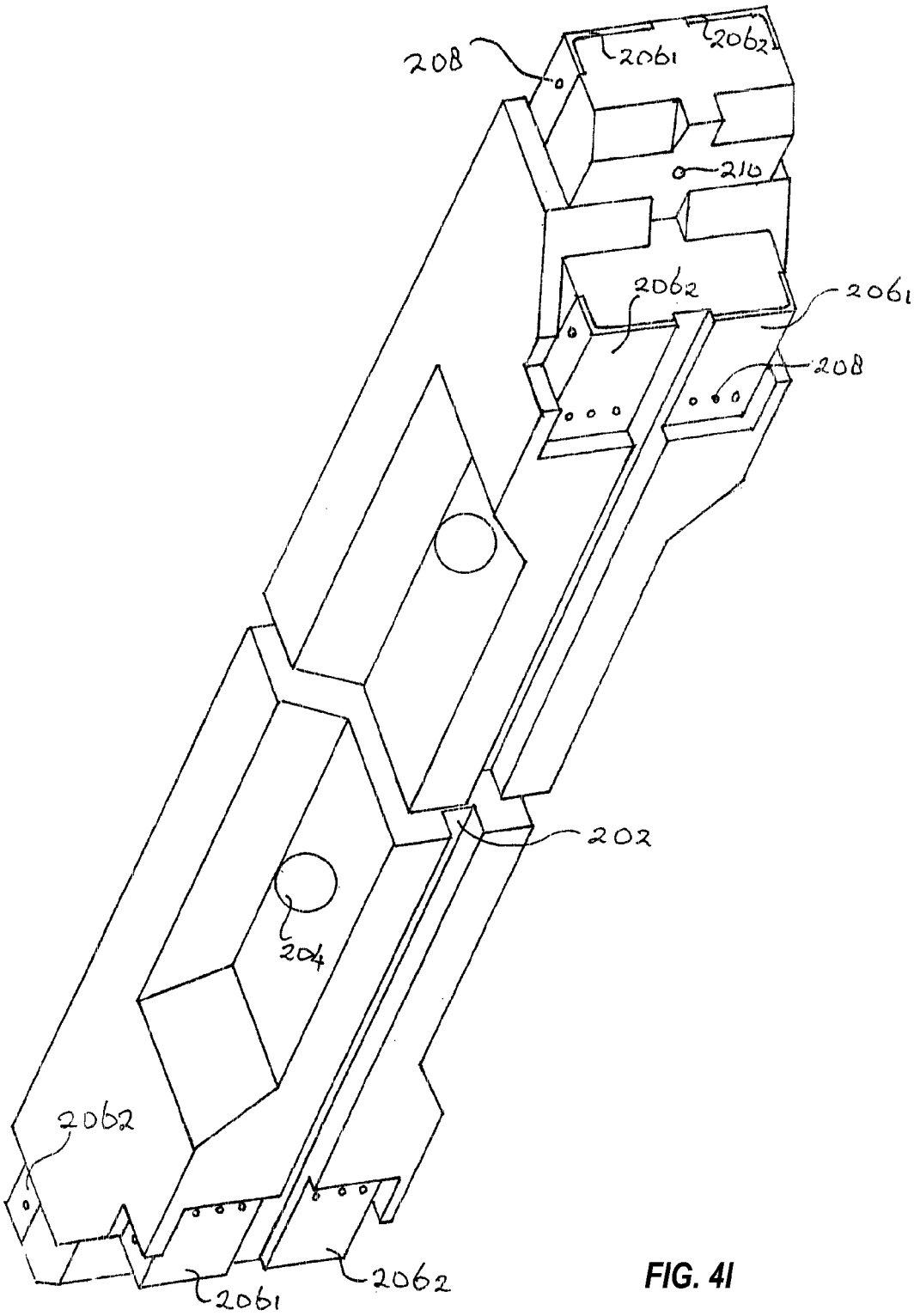
FIG. 4I shows a perspective view of a floor-supporting beam component according to an embodiment of this invention.
Figure 4J:
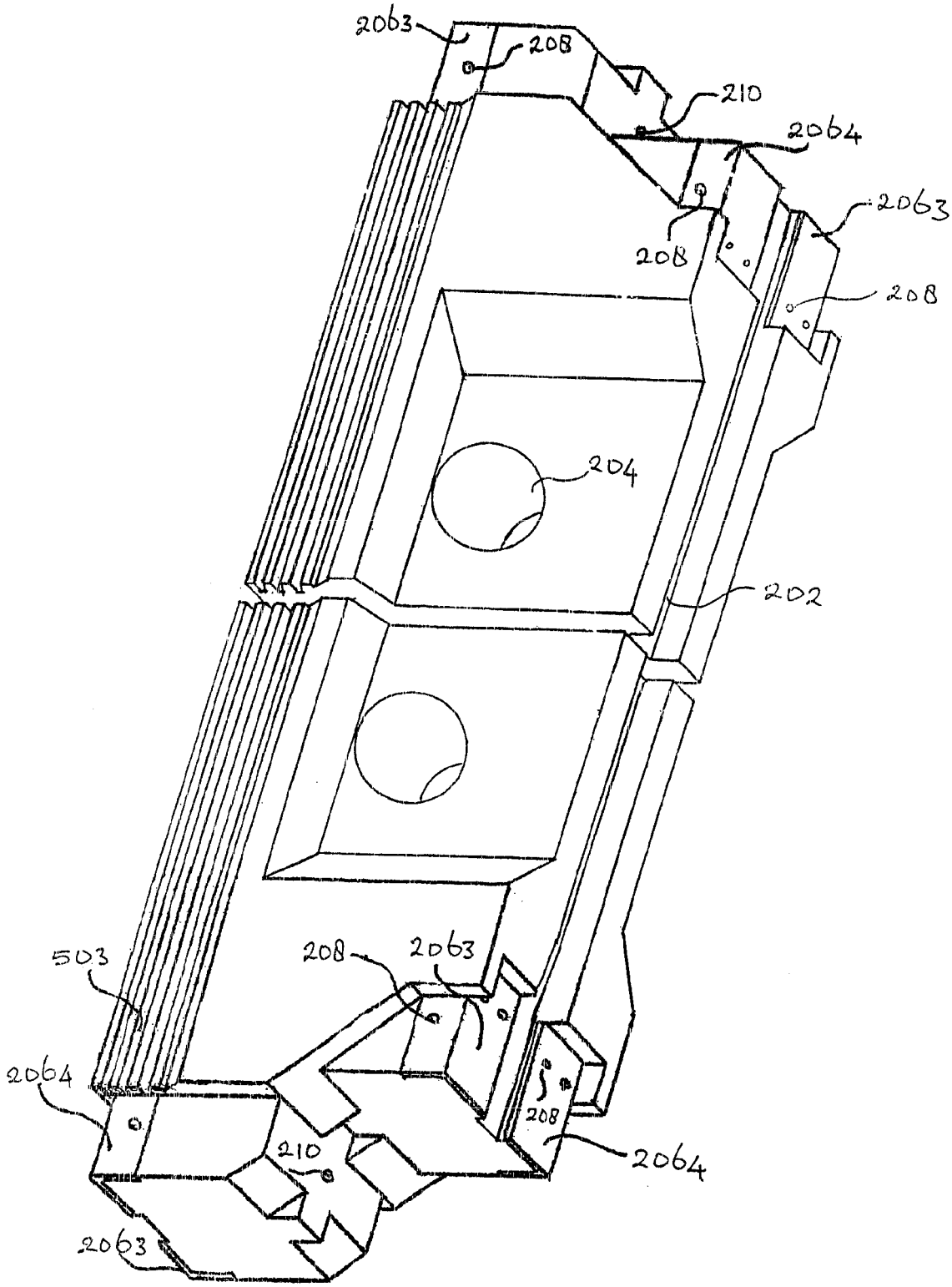
FIG. 4J shows a perspective view of a wall-supporting beam component according to an embodiment of this invention.

FIG. 4I shows a perspective view of a floor-supporting beam, according to an embodiment in this invention.

FIG. 4J shows a perspective view of a wall-supporting beam, according to an embodiment in this invention.

Figure 4K:
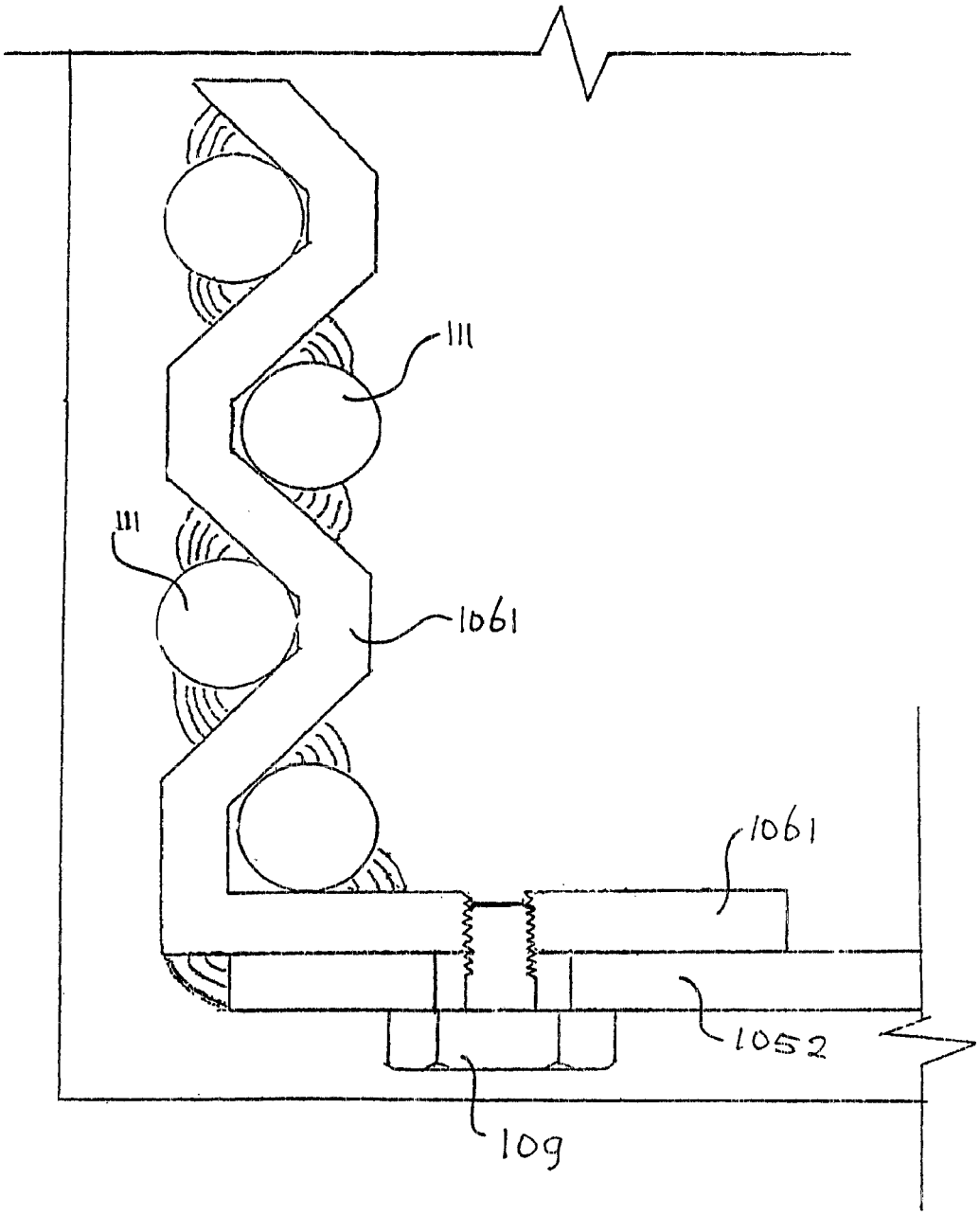
FIG. 4K shows an alternative shape for the right-angle steel joint between column and beam components according to an embodiment of this invention.

FIG. 4K shows an alternative construction of the right-angle steel plates (1061, 1062, 1063, 1064, 2061, 2062, 2063, 2064) connecting column to beam components, according to an embodiment in this invention.

Figures 5A, 5B, 5C:
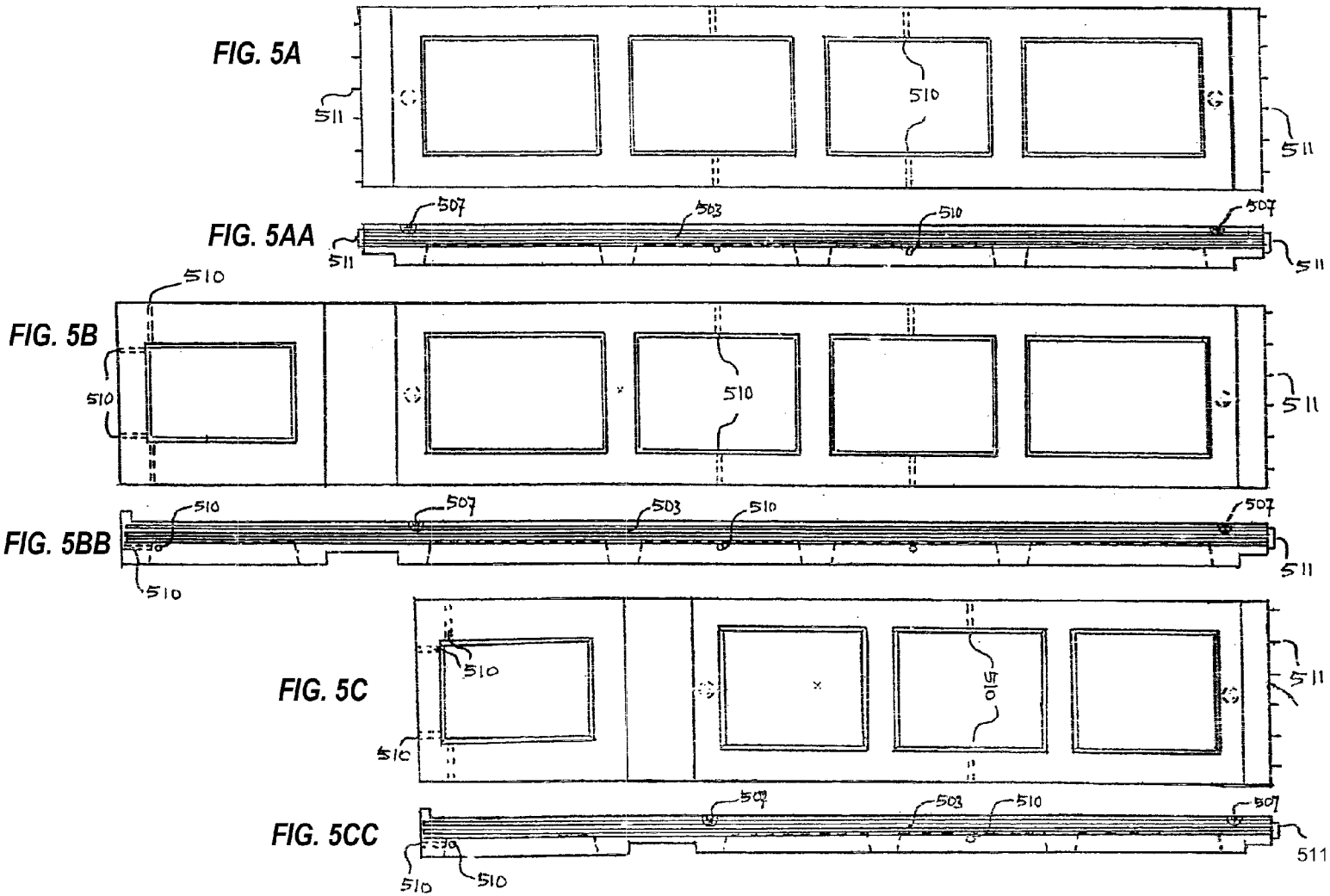
FIGS. 5A and 5AA show the bottom and side views of a middle floor component according to an embodiment of this invention.
FIGS. 5B and 5BB show the bottom and side views of a front floor component according to an embodiment of this invention.
FIGS. 5C and 5CC show the bottom and side views of a rear floor component according to an embodiment of this invention.

FIG. 5A shows a bottom view of a precast center floor component. It has bolt holes 510 to tie to other floor components, and steel hooks 511 to tie to beam and other floor components. FIG. 5AA shows a side view of the center floor component, showing the grooves 503 on its side that will be grouted with other floor components.

FIG. 5B shows a top view of a precast front floor component. It has bolt holes 510 on its sides to tie to other floor components, and on its end to tie to parapet components, and steel hooks 511 to tie to beam and other floor components. FIG. 5BB shows a side view of the front floor component, showing the grooves 503 on its side that will be grouted with other floor components.

FIG. 5C shows a bottom view of a precast back floor component. It has bolt holes 510 to tie to other floor components, and at the end to tie to outer wall components, and steel hooks 511 which tie to beam and other floor components. FIG. 5CC shows a side view of the front floor component, showing the grooves 503 on its side that will be grouted with other floor components.

Figure 5D:
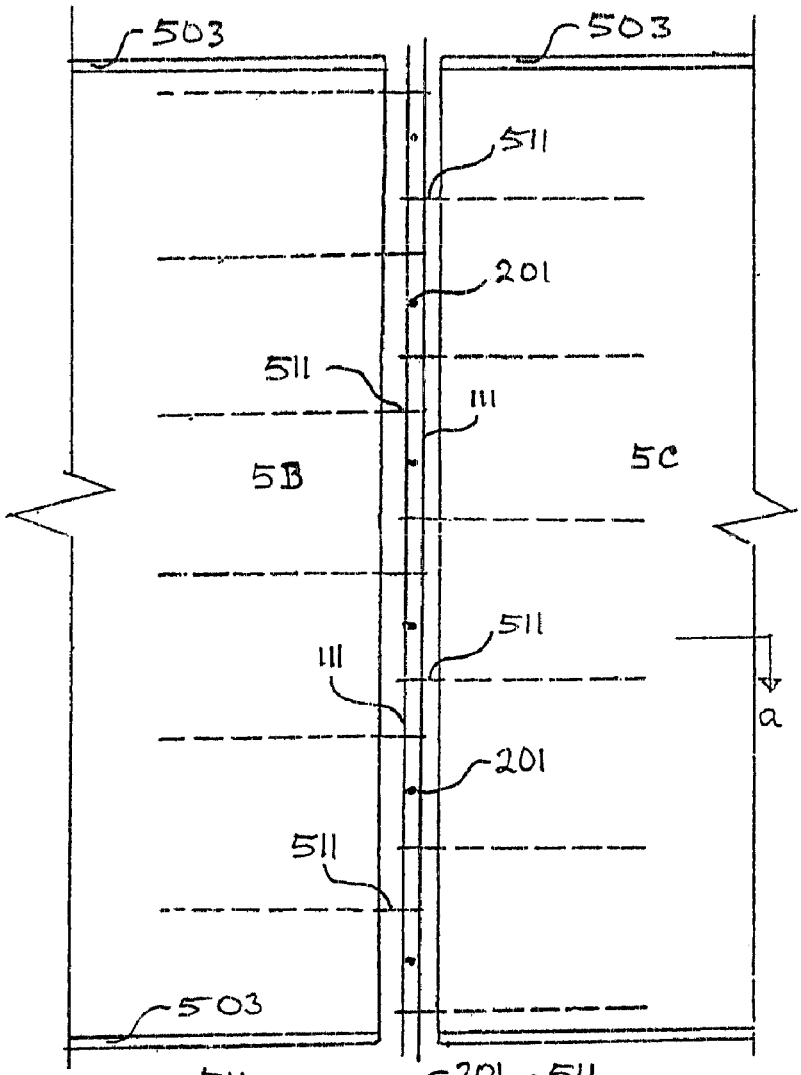
FIG. 5D shows a top view of the attachment of floor components to each other above a floor-supporting beam component according to an embodiment of this invention.
Figure 5E:
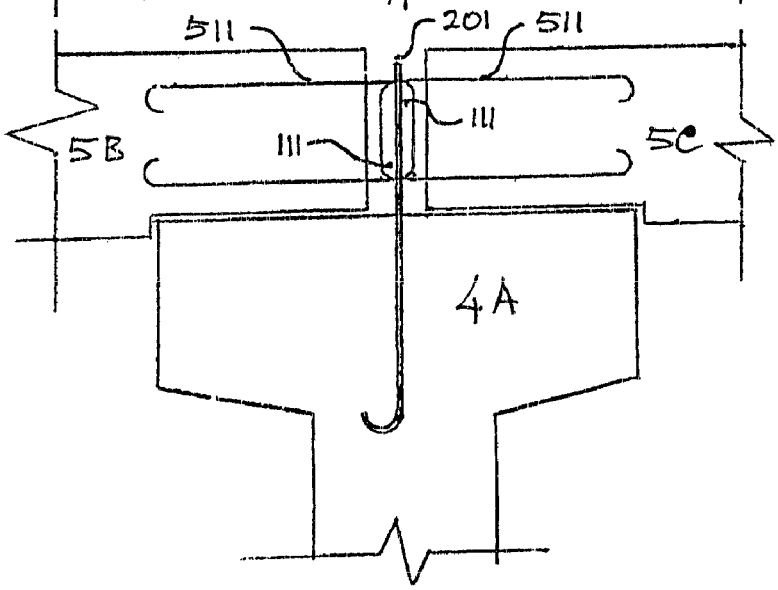
FIG. 5E shows a side view of the attachment of floor components to a floor-supporting beam component according to an embodiment of this invention.

FIG. 5D shows a top view of the attachment of floor components to each other above a floor-supporting beam component according to an embodiment of this invention. FIG. 5E shows a vertical cross section of the connection between floor components on top of a floor-supporting beam. Floor components (5B and 5C) with their steel hooks 511 are placed on top of a beam 4A with the steel stakes 201. A rebar 111 is threaded through the hooks and then the joint is grouted in concrete.

Figure 5F:
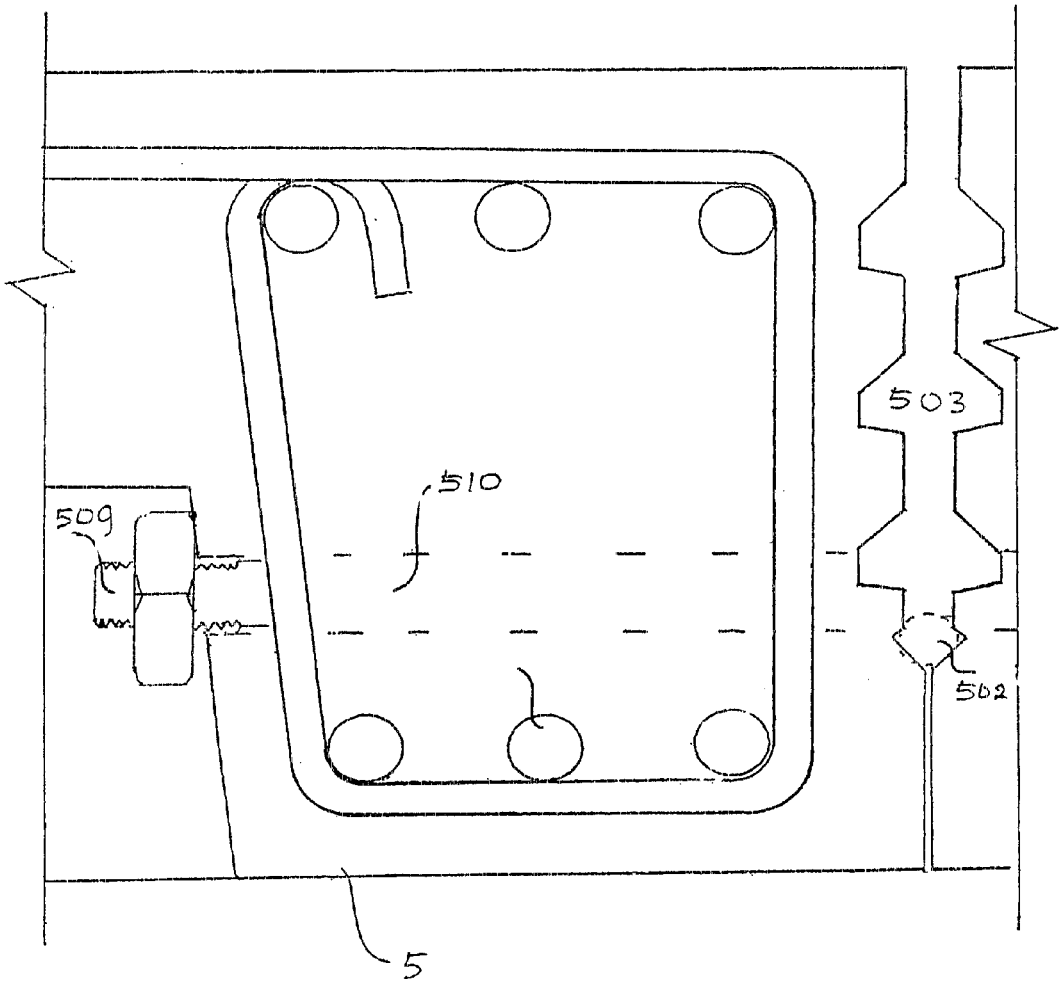
FIG. 5F shows a leak-proof connection between floor components according to an embodiment of this invention.

FIG. 5F shows the connection between floor components on the side, or between a floor component and a wall-supporting beam. It has toothed grooves 503, bolt-holes 510 and bolts tying the components. A round styrofoam seal 502 is placed inside the groove 503 before it is grouted in concrete to form a leak-proof joint, according to an embodiment in this invention.

Figure 6C:
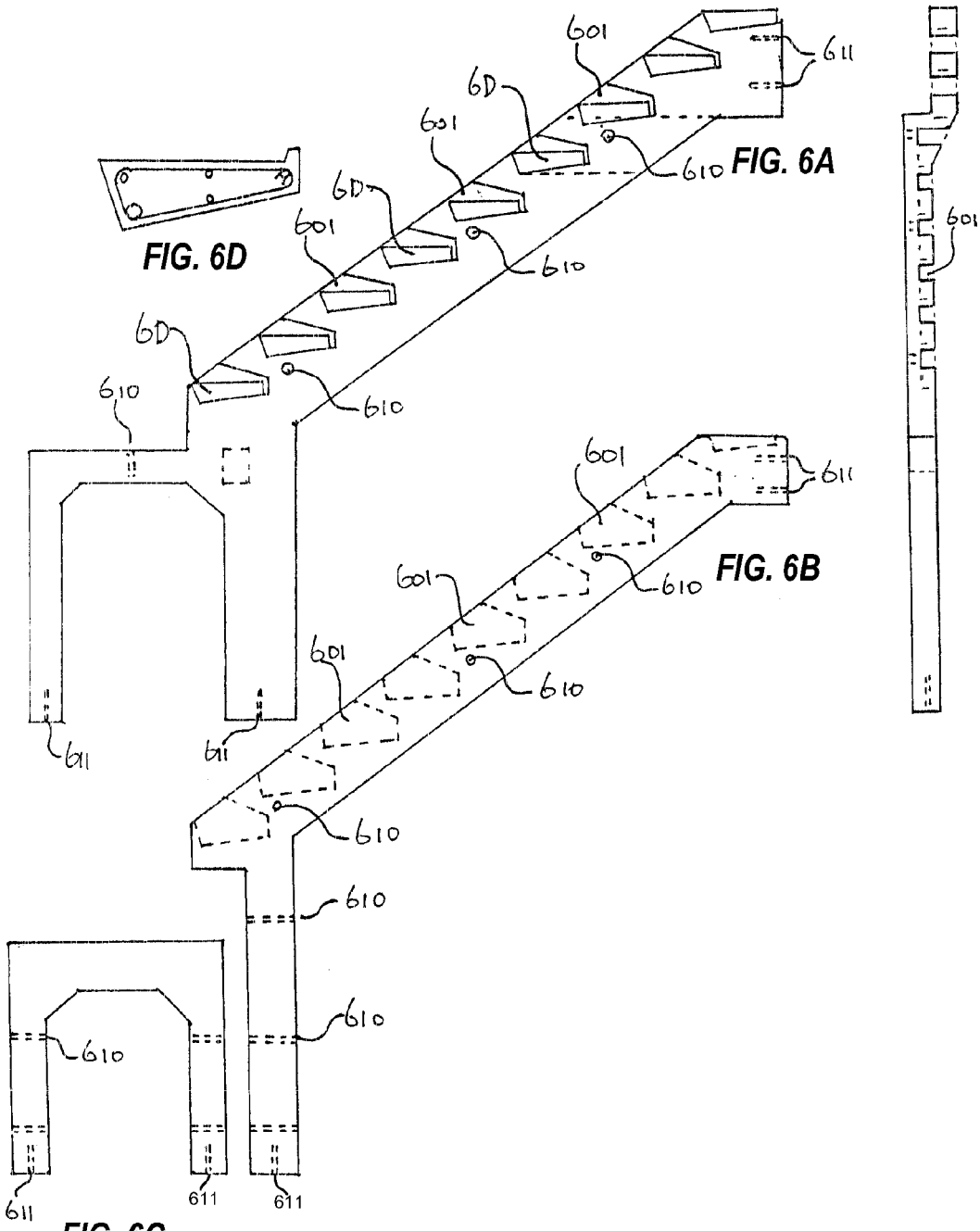
FIG. 6C shows a stair connector beam according to an embodiment of this invention.
Figure 6E:
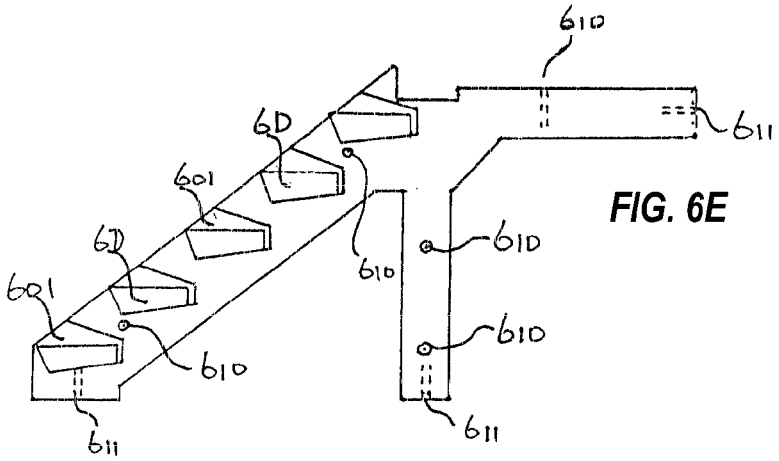
FIG. 6E shows a lower stair beam component placed next to a wall according to an embodiment of this invention.
Figure 6F:
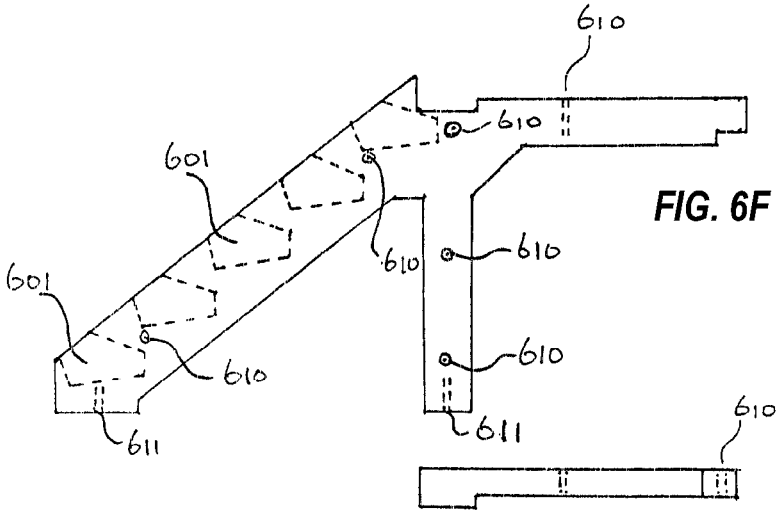
FIG. 6F shows a lower stair beam component placed away from the wall according to an embodiment of this invention.
Figure 6G:
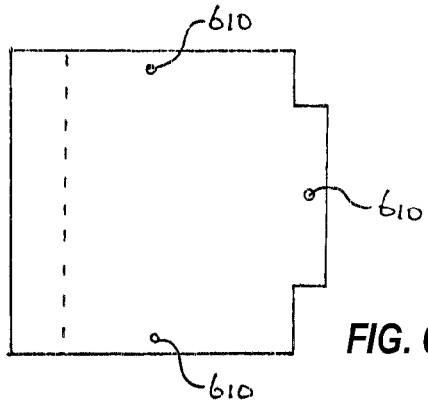
FIG. 6G shows a stair platform component according to an embodiment of this invention.
Figure 6H:
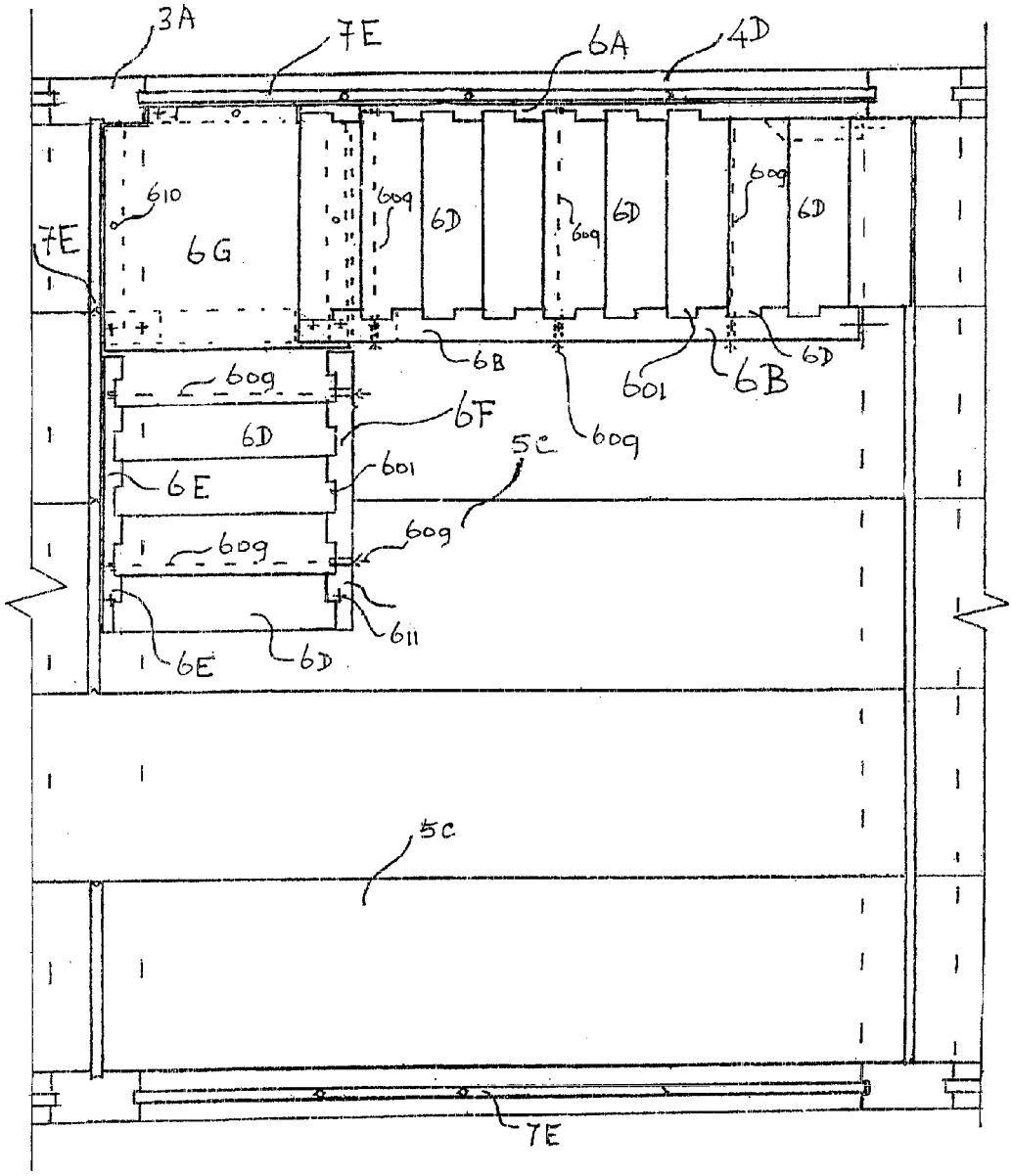
FIG. 6H shows the layout of stair components according to an embodiment of this invention.

FIGS. 6A, 6B, 6C, 6E and 6F show vertical cross-sections of precast stair beam components, according to an embodiment in this invention. The stairs in this invention are composed of stair beam components 6A, 6B, 6E, 6F, (as shown in FIG. 6H) with slots 601 to place stair tread components as shown in FIG. 6D (denoted as 6D in other views), as well as a stair platform component as shown in FIG. 6G (denoted as 6G in other views), that is placed on the other stair components 6A, 6C, 6E, 6F. This stair platform component 6G is also made of pre-cast concrete in the specified shape, size and strength. Stair beam components in this invention have holes 610 for steel ties 609 to tie stair components 6A to 6B and 6E to 6F. Stair beam components 6E, 6F and the connector as shown in FIG. 6C are joined together using the steel ties 609 at the holes 610. The top end of the stair beam as shown in FIG. 6A have steel stakes 611 to tie it to the floor-supporting beam of FIG. 4A. The bottom end of the stair beam components 6A, 6B, 6C, 6E, 6F also have stakes to tie them to floor components. Stair beam component 6E is installed flush to a wall component 7E shown in FIG. 6H, that is wedged in the groove 202 of a beam component, according to an embodiment in this invention.

FIG. 6D shows a cross-section of the precast stair tread component 6D which is trapezoidal-shaped in this invention. The front part is thicker than the back part to provide more strength when stepped on. Furthermore, the tread will not easily slide due to the difference in thickness. These stair tread components 6D are simply placed in the slots 601 on the stair beam components, according to an embodiment in this invention.

FIG. 6H illustrates the layout of pre-cast concrete stair components, according to an embodiment in this invention. The stairs consist of a stair beam component 6A placed next to a wall 7E and below a wall-supporting beam 4D, a stair beam component 6E placed next to a wall 7E, a stair beam component 6B tied to stair beam component 6A using steel ties 609, a stair beam component 6F tied to stair beam component 6E using steel ties 609, a stair platform component 6G, and a number of stair treads 6D. Stair beam component 6E is united to stair beam component 6F using steel ties 609 such that stair tread components 6D are tied securely between the stair beam components, according to an embodiment in this invention.

Figures 7A, 7B, 7C, 7D, 7E:
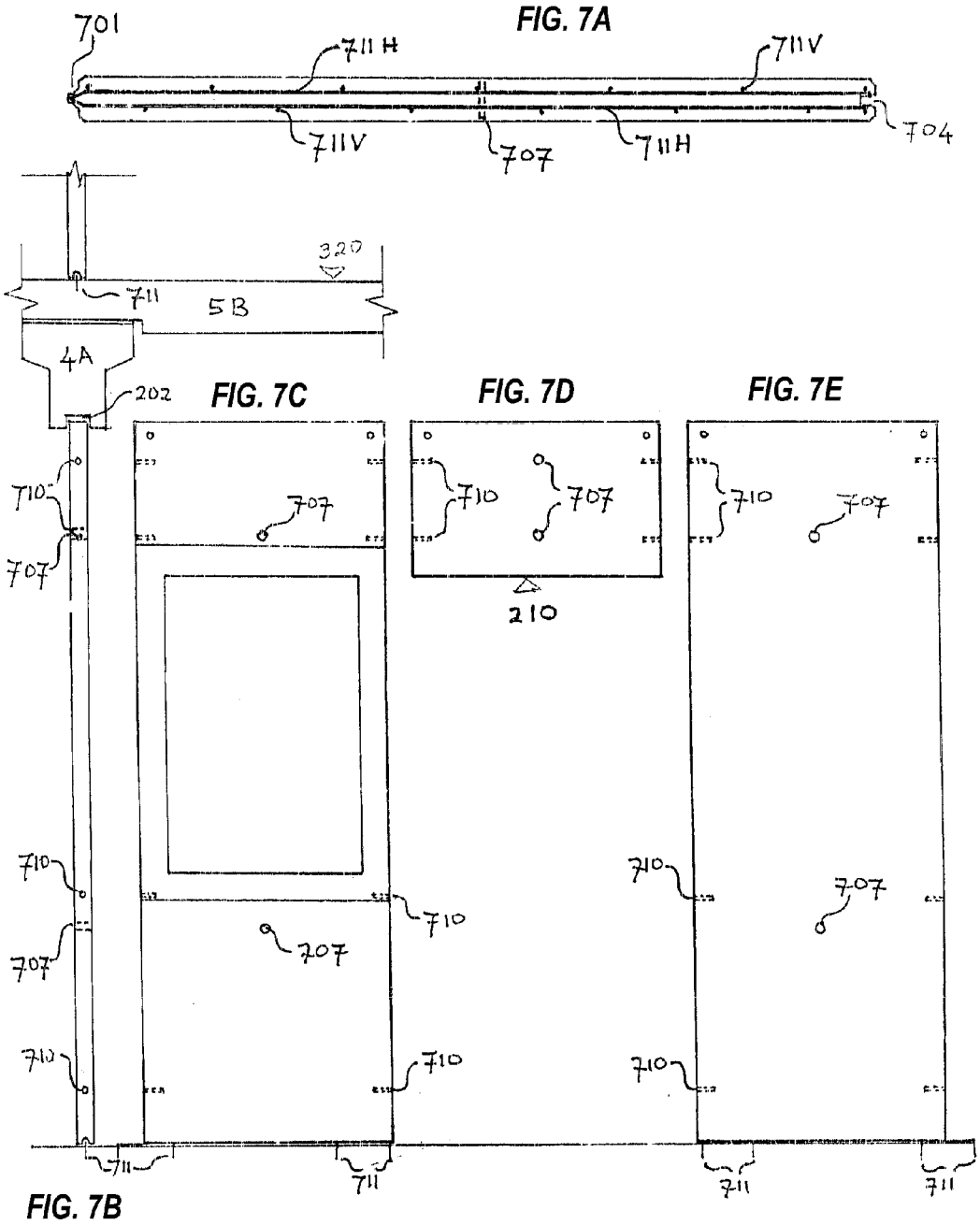
FIG. 7A shows a steel layout in a cross-section of a wall component according to an embodiment of this invention.
FIG. 7B shows a cross section of an inner wall component according to an embodiment of this invention.
FIG. 7C shows an inner wall component with a window according to an embodiment of this invention.
FIG. 7D shows a wall component above a door according to an embodiment of this invention.
FIG. 7E shows an inner wall component according to an embodiment of this invention.

FIG. 7A shows a horizontal cross-section of a precast wall component, according to an embodiment in this invention, where the rebars inside the wall 7A are arranged vertically 711V and horizontally 711H. There are also holes 710 for steel stakes (not shown in this view), and holes 707 to lift the wall for construction, according to an embodiment in this invention. A side tongue 701 is formed along one side of the wall component and a side groove 704 along the other side of the wall component, connecting wall components together.

FIG. 7B shows a vertical cross-section of a precast inside wall component, according to an embodiment in this invention, showing the stake holes 710 and lift holes 707. The wall is inserted into the groove 202 below the beam 4A and is secured to the floor using U-shaped steel bars 711 inserted into the floor.

FIG. 7C shows a precast inside wall component with a window, according to an embodiment in this invention. U-shaped steel bars 711 are inserted into the floor below the wall. At the top, the wall is inserted into the groove 202 in the beam 4A. The wall has holes 710 for stakes to tie it to the walls beside it and holes 707 to lift it up for installation.

FIG. 7D shows a precast wall component to be placed above a door. This component also has holes 707 to lift it up, and holes 710 for steel stakes. The number 210 indicates the component is installed at the height of 210 cm from the floor.

FIG. 7E shows a precast inside wall component installed above the floor, according to an embodiment of this invention. The component has holes 710 to tie it to the other wall components next to it and holes 707 to lift it up for installation. U-shaped steel bars 711 are inserted into the floor below the wall to prevent the wall from sliding.

Figure 7F:
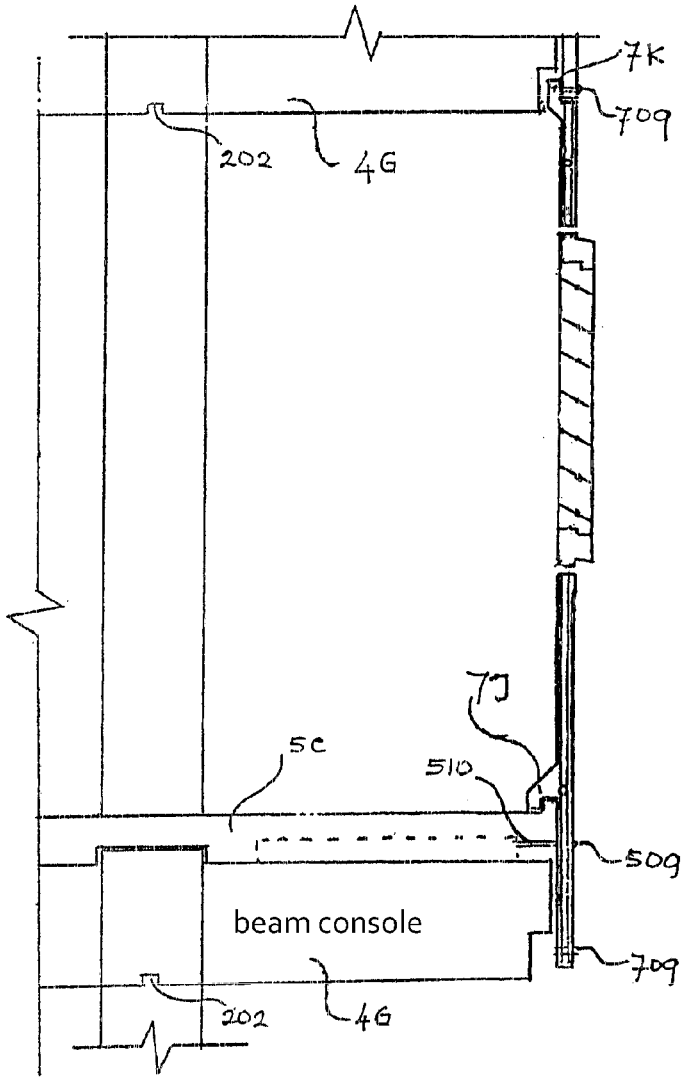
FIG. 7F shows a vertical cross section of an outer wall component with a window according to an embodiment of this invention.
Figure 7G:
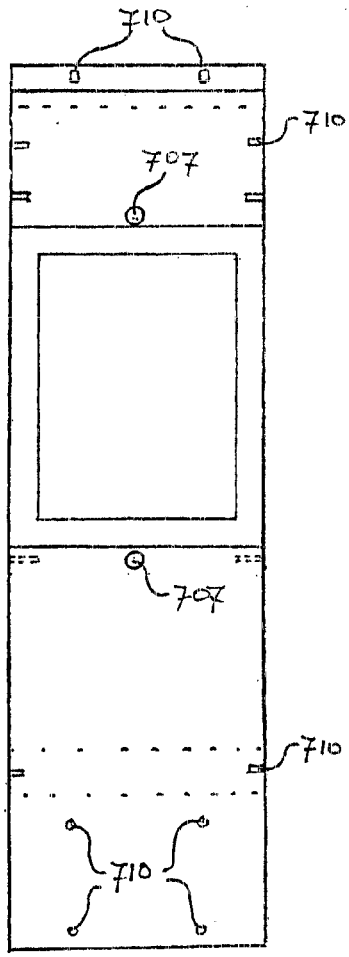
FIG. 7G shows an outer wall component with a window according to an embodiment of this invention.

FIG. 7F shows a vertical cross-section of a precast outside wall component with a window connected to the end of a floor 5C. The joint 7J is placed on top of the floor end and then it is bolted 509 to the floor at the prepared holes 510. The top is shaped as 7K and bolted 709 to the bottom of the wall above. FIG. 7G shows a front view of the outside wall component with a window. It shows stake holes 710 on the sides, bolt holes 710 to bolt it to the floor 509 and to the walls 709 above and below, as well as holes 707 for lifting the wall.

Figures 7H, 7I:
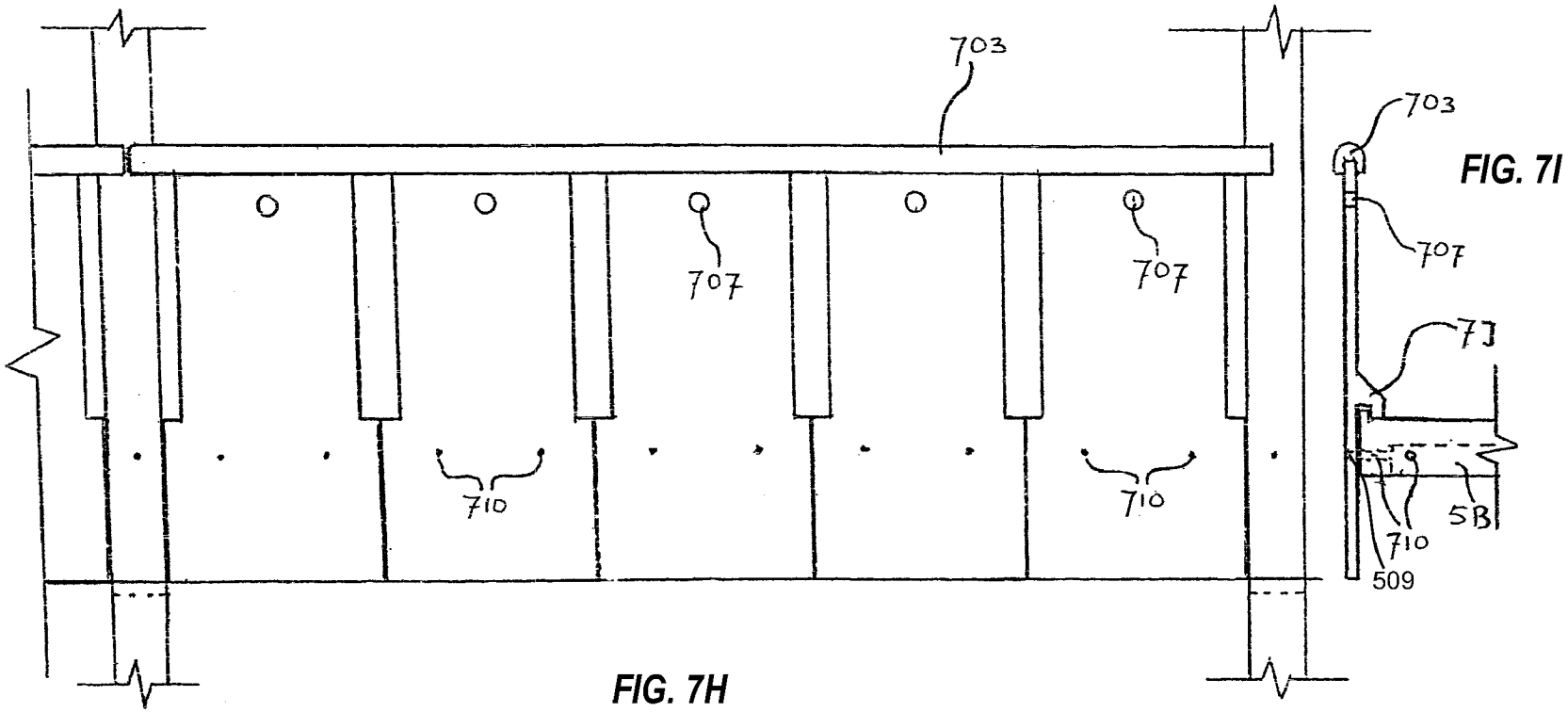
FIG. 7H shows a parapet wall component according to an embodiment of this invention.
FIG. 7I shows the connection between the parapet wall and floor components according to an embodiment of this invention.

FIG. 7H shows a front view of precast concrete parapet wall components, with holes 710 to bolt 509 them to the floor components 5B and holes 707 to lift them during installation. A round concrete component 703 is placed on top to serve as railing. FIG. 7I shows a vertical cross section of the parapet wall component. The joint 7J is placed on top of the floor end 5B and then bolted 509.

Figure 7J:
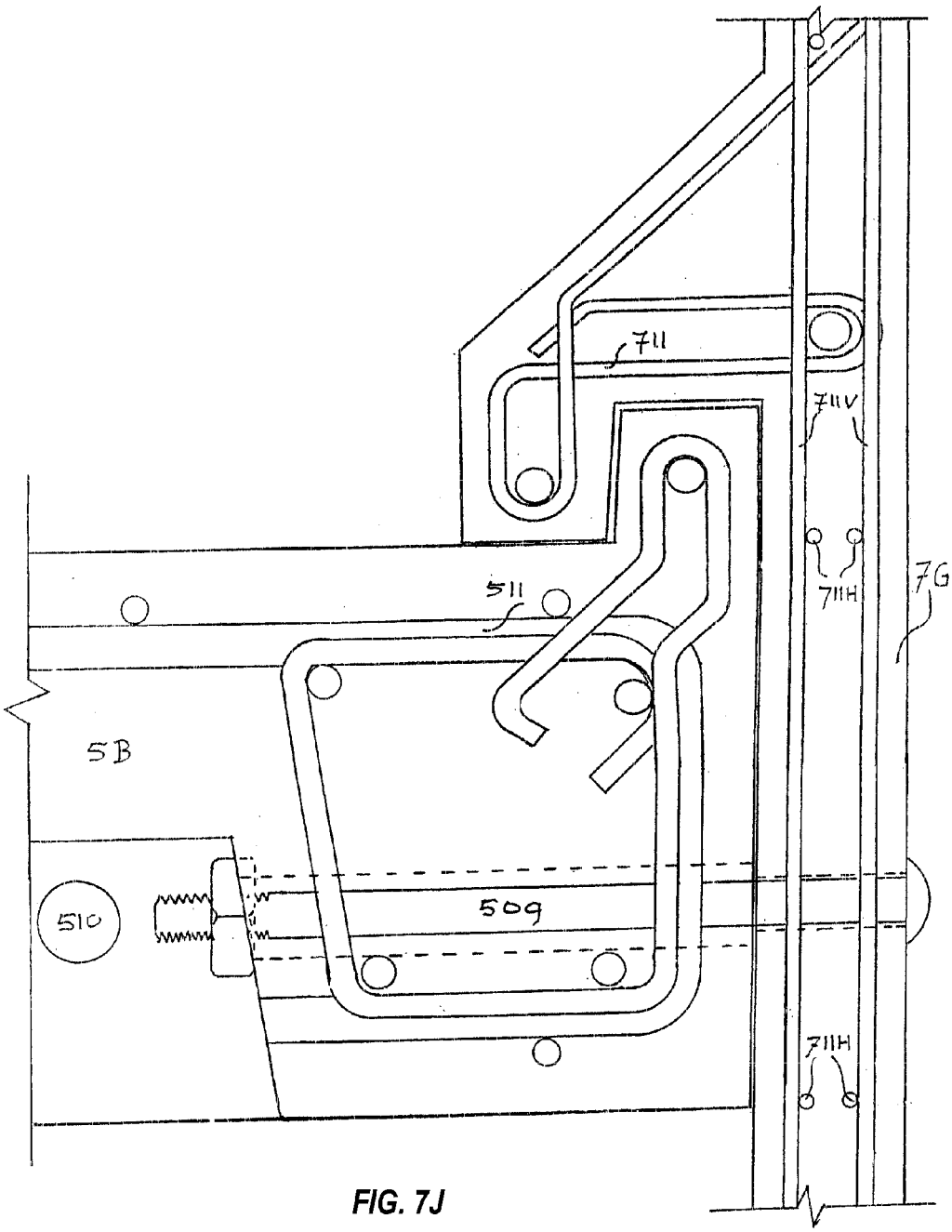
FIG. 7J shows a vertical cross-section of the connection between floor and outer wall components according to an embodiment of this invention.

FIG. 7J shows a cross section of the joint between floor component (5B, 5C) and outside wall component 7G. The wall component is placed on top of the floor ends (5B, 5C) and then secured by bolts 509.

Figure 7K:
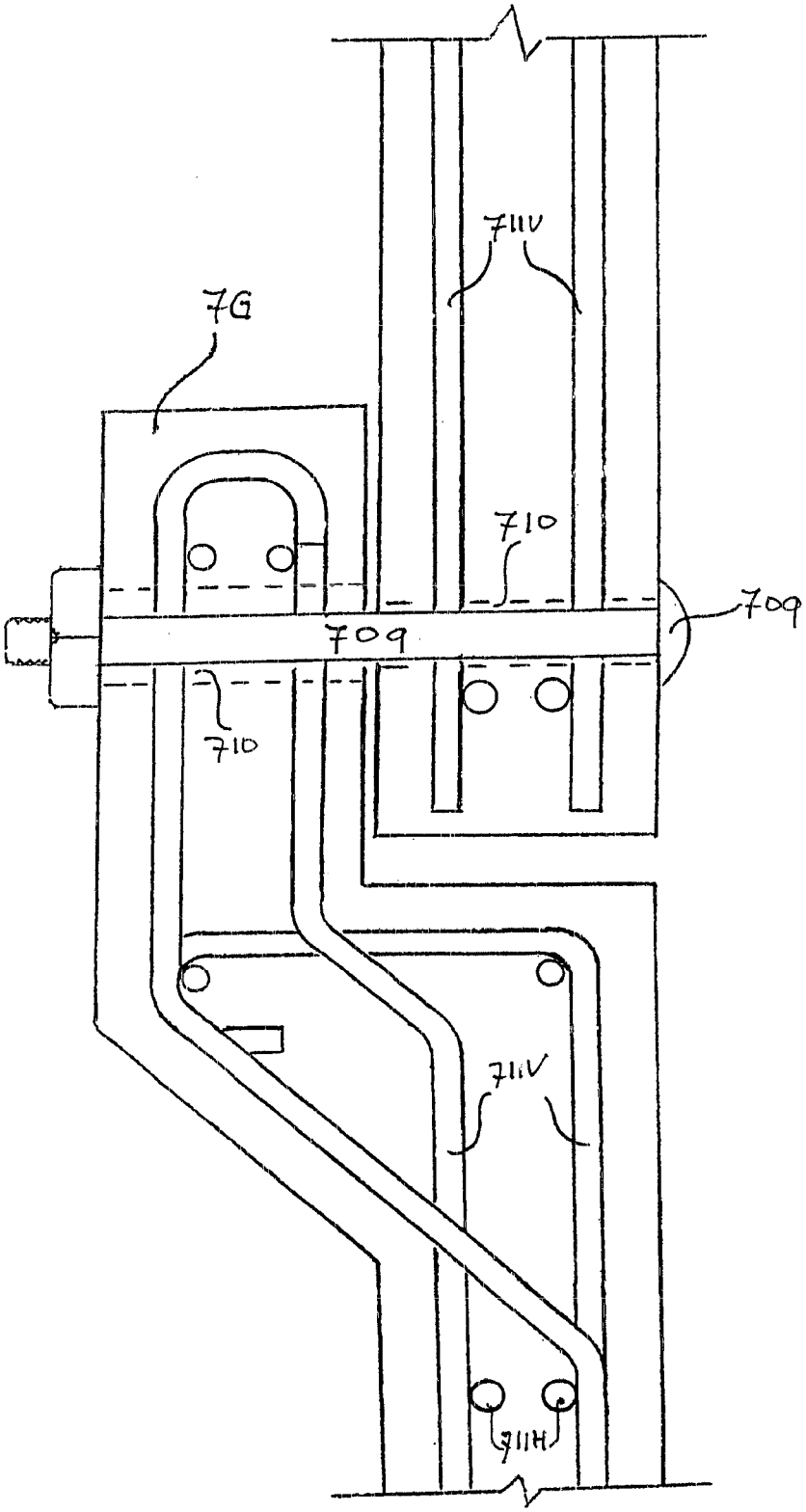
FIG. 7K shows a vertical cross-section of the connection between the bottom and the top of outer wall components according to an embodiment of this invention.

FIG. 7K shows a cross section of the joint between an outside wall component 7G and the wall above it. They are bolted 709 through the holes 710 at the top and bottom of the wall components, according to an embodiment in this invention.

Figure 7L:
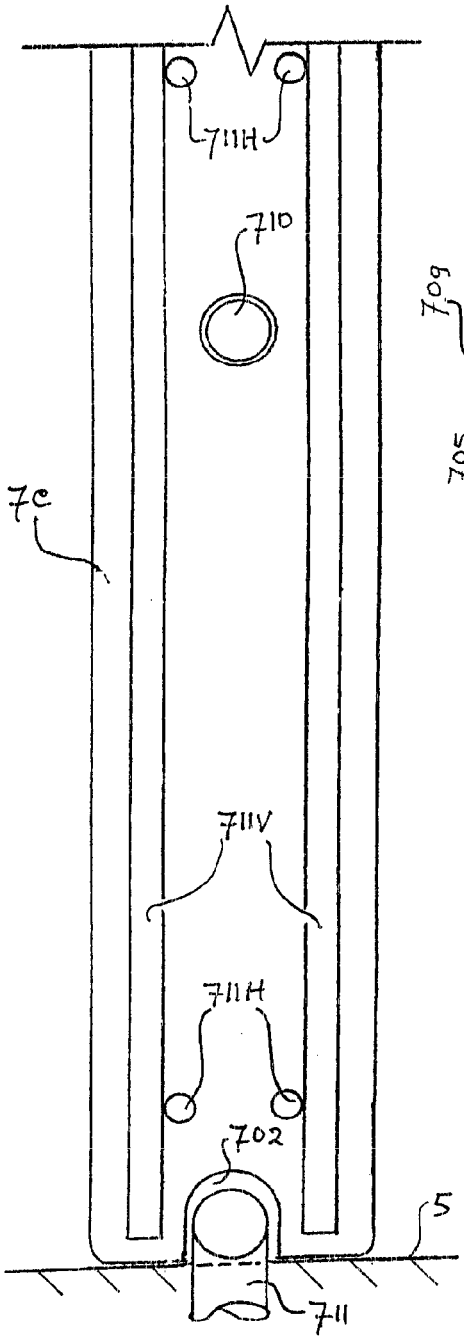
FIG. 7L shows a vertical cross-section of the connection between a floor component and the bottom of an inner wall component in this invention.

FIG. 7L shows a vertical cross-section of the bottom end of an inside wall component 7C. To secure the wall, a groove 702 is made at the bottom of the wall and placed on top of U-shaped steel bars 711 inserted into the floor.

Figure 7M:
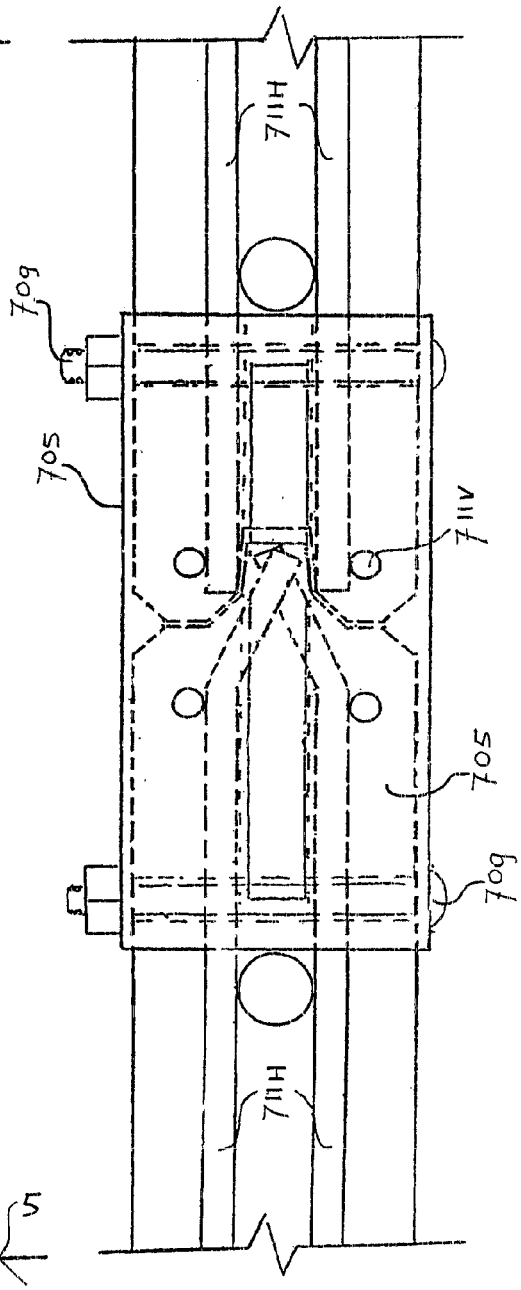
FIG. 7M shows a horizontal cross-section of the connection between wall components according to an embodiment of this invention.

FIG. 7M shows a horizontal cross-section of the connection between sides of wall components using U-shaped steel plates 705 that are bolted 709, according to an embodiment in this invention.

Figure 7N:
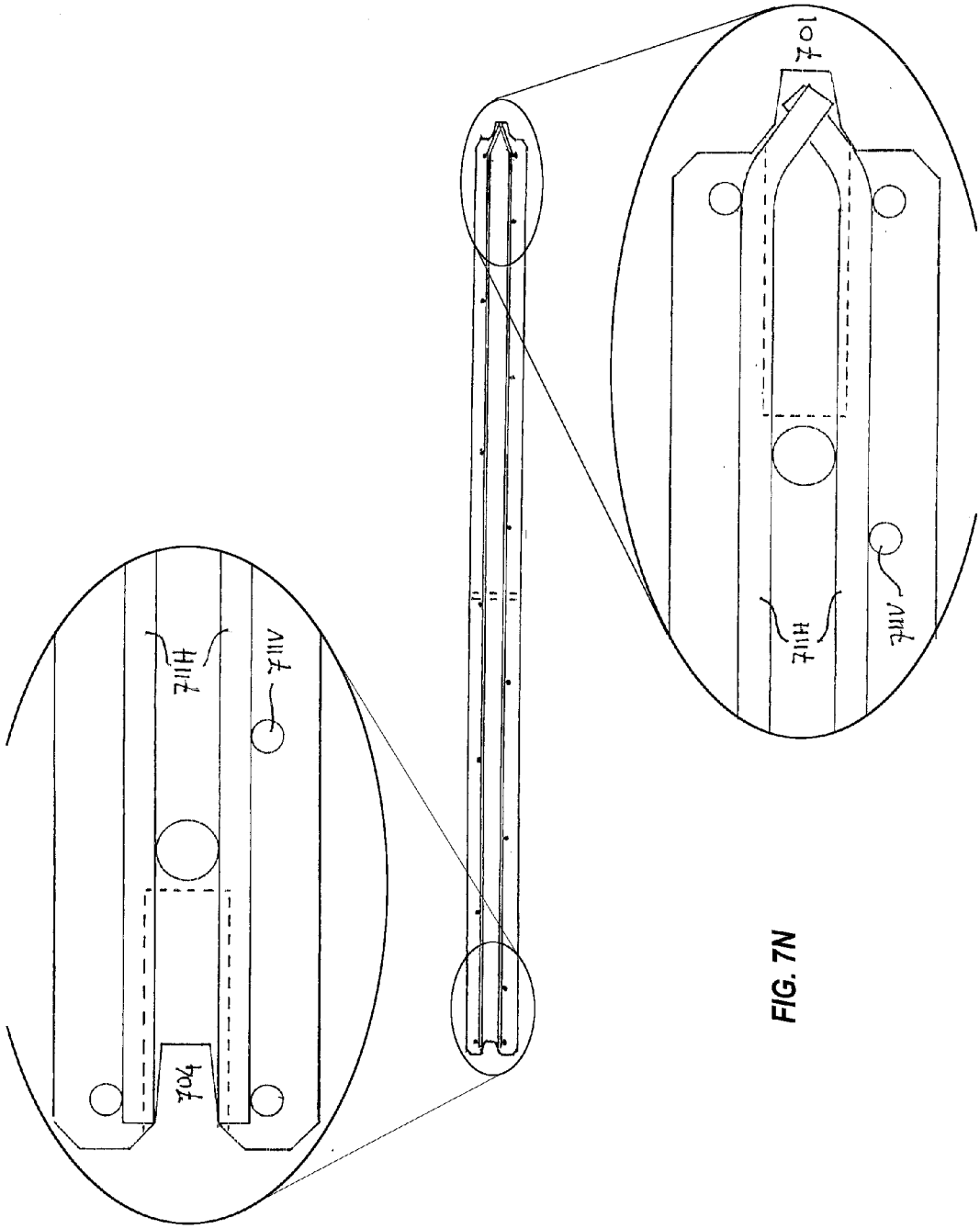
FIG. 7N shows detail of the horizontal cross-section and rebar placement in a wall component according to an embodiment of this invention.

FIG. 7N shows a horizontal cross section of a wall component, in detail view, showing the layout of vertical 711V and horizontal 711H rebars. A groove 704 is made on a side of the wall to match the tongue 701, according to an embodiment in this invention.

Figure 7P:
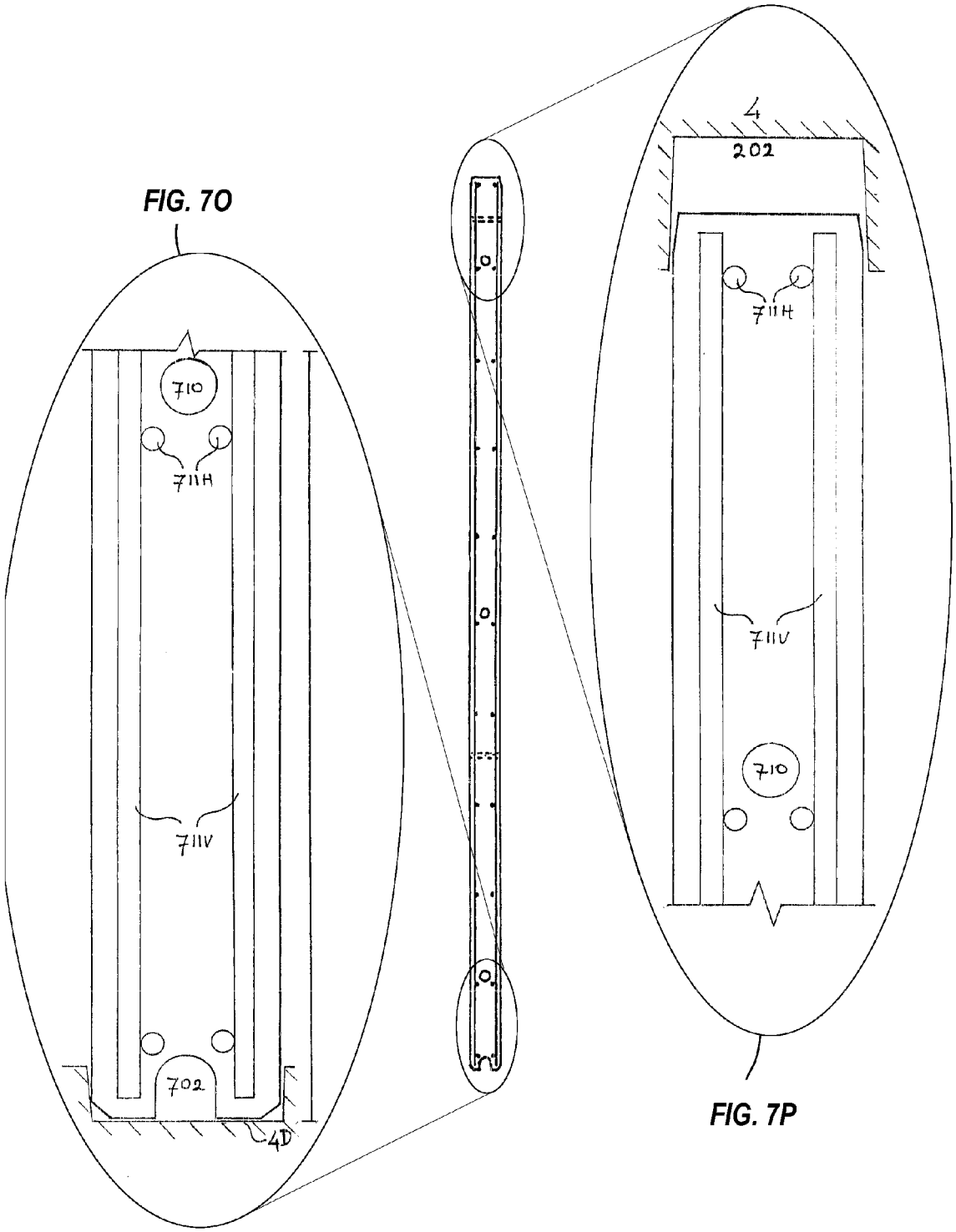
FIG. 7P shows the detail view of the cross-section of the connection between the top of an inner wall component and a beam component in this invention.

FIG. 7O shows a vertical cross-section of a wall component, in detail view, showing the layout of vertical 711V and horizontal 711H rebars, and a groove 702 at the bottom. FIG. 7P shows the tapered shape on the top to facilitate installation into the groove 202 at the bottom of a beam, according to an embodiment in this invention.

Figure 8A:
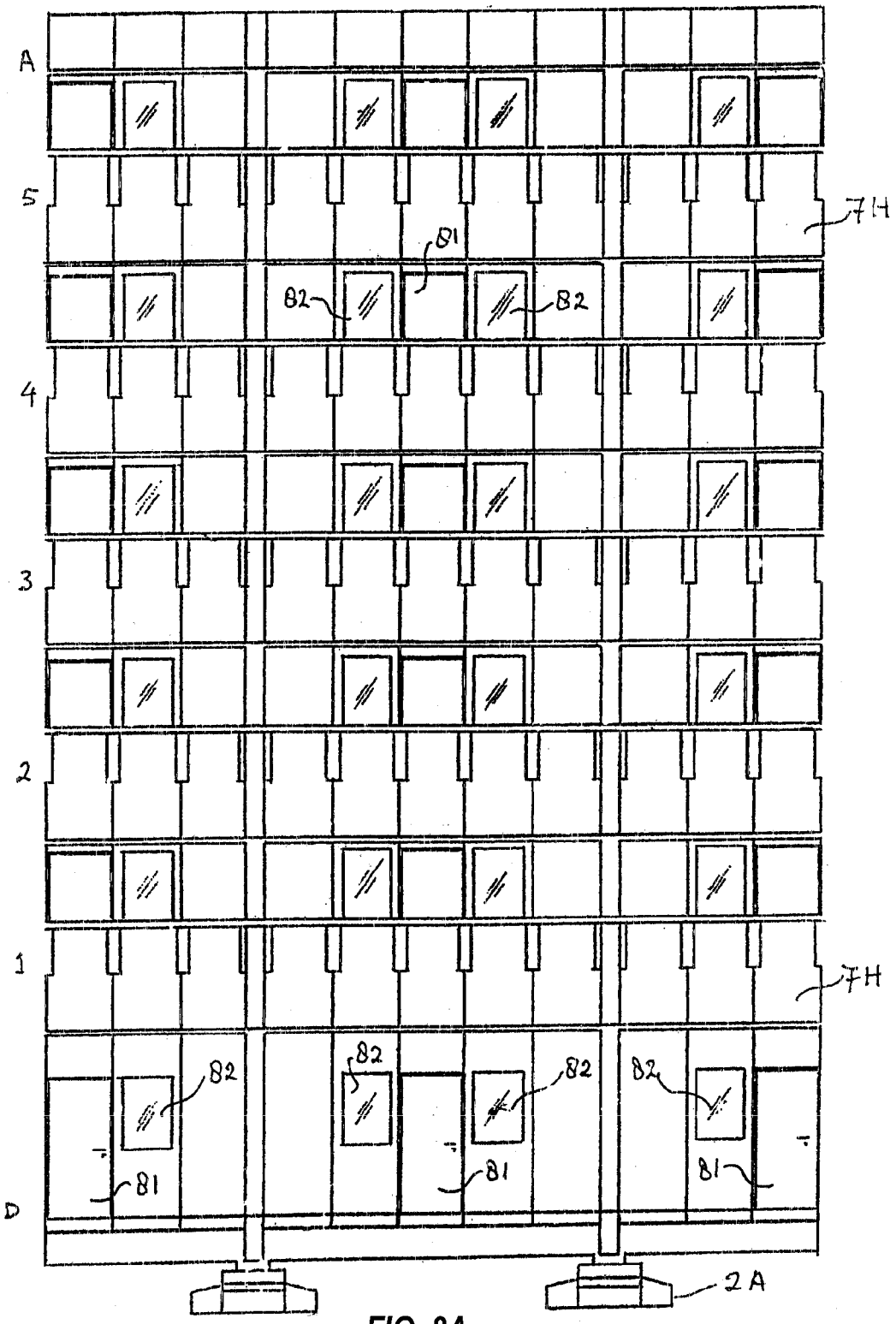
FIG. 8A shows a front view of a six-story apartment building constructed from the concrete components of and according to an embodiment of this invention.

FIG. 8A shows a front view of a six-story apartment building using an embodiment of this invention, with a terrace and parapet 7H in front and doors 81 and windows 82 on each unit.

Figure 8B:
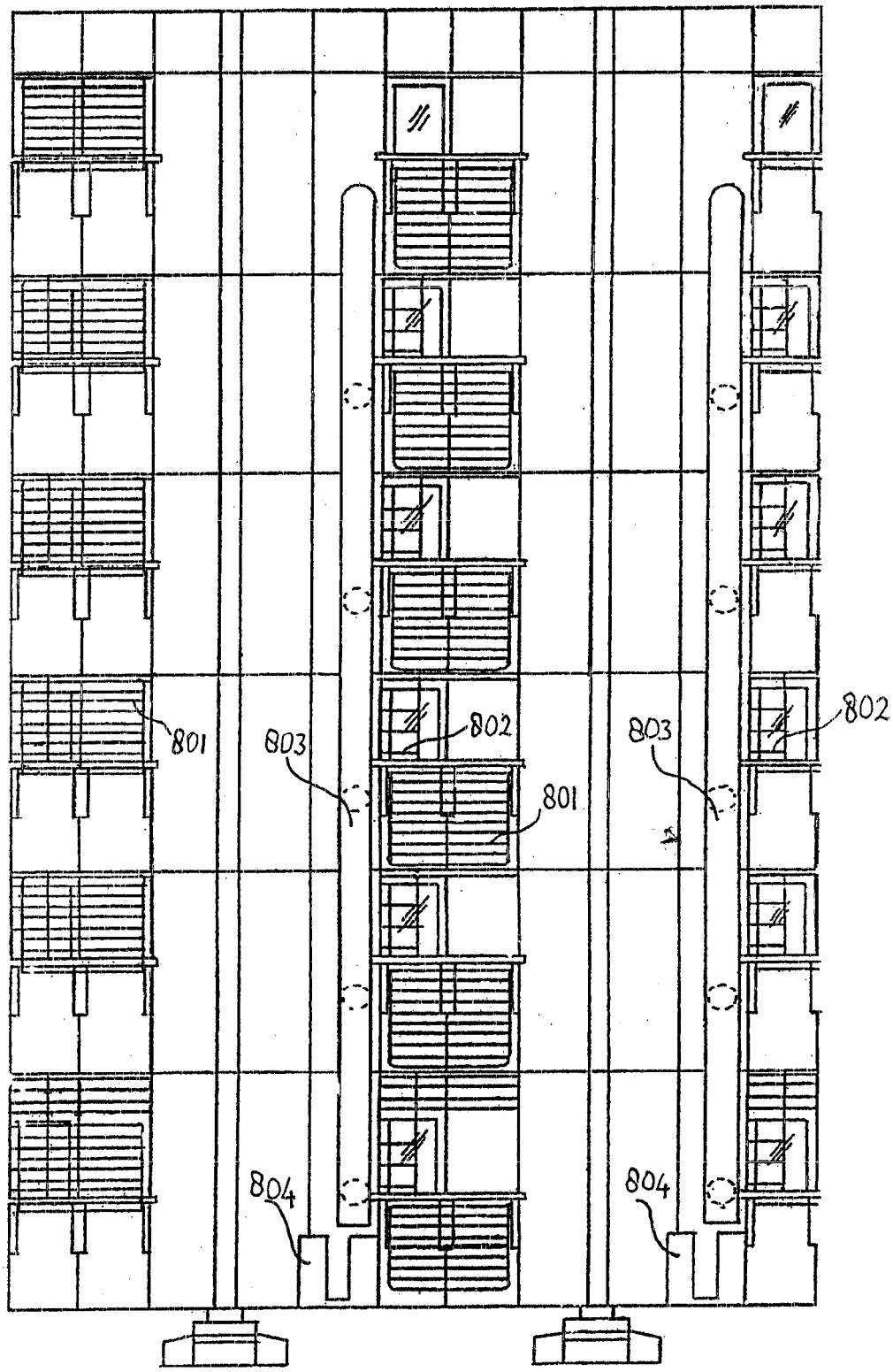
FIG. 8B shows a rear view of a six-story apartment building constructed from the concrete components of and according to an embodiment of this invention.

FIG. 8B shows a rear view of a six-story apartment building using an embodiment of this invention, equipped with clothes drying racks 801 that combined with the steel ladders 802 can also serve as emergency ladders for evacuation in case of fire. Also shown are garbage chutes 803 and garbage bins 804 for each housing unit constructed with this invention method.

Figure 8C:
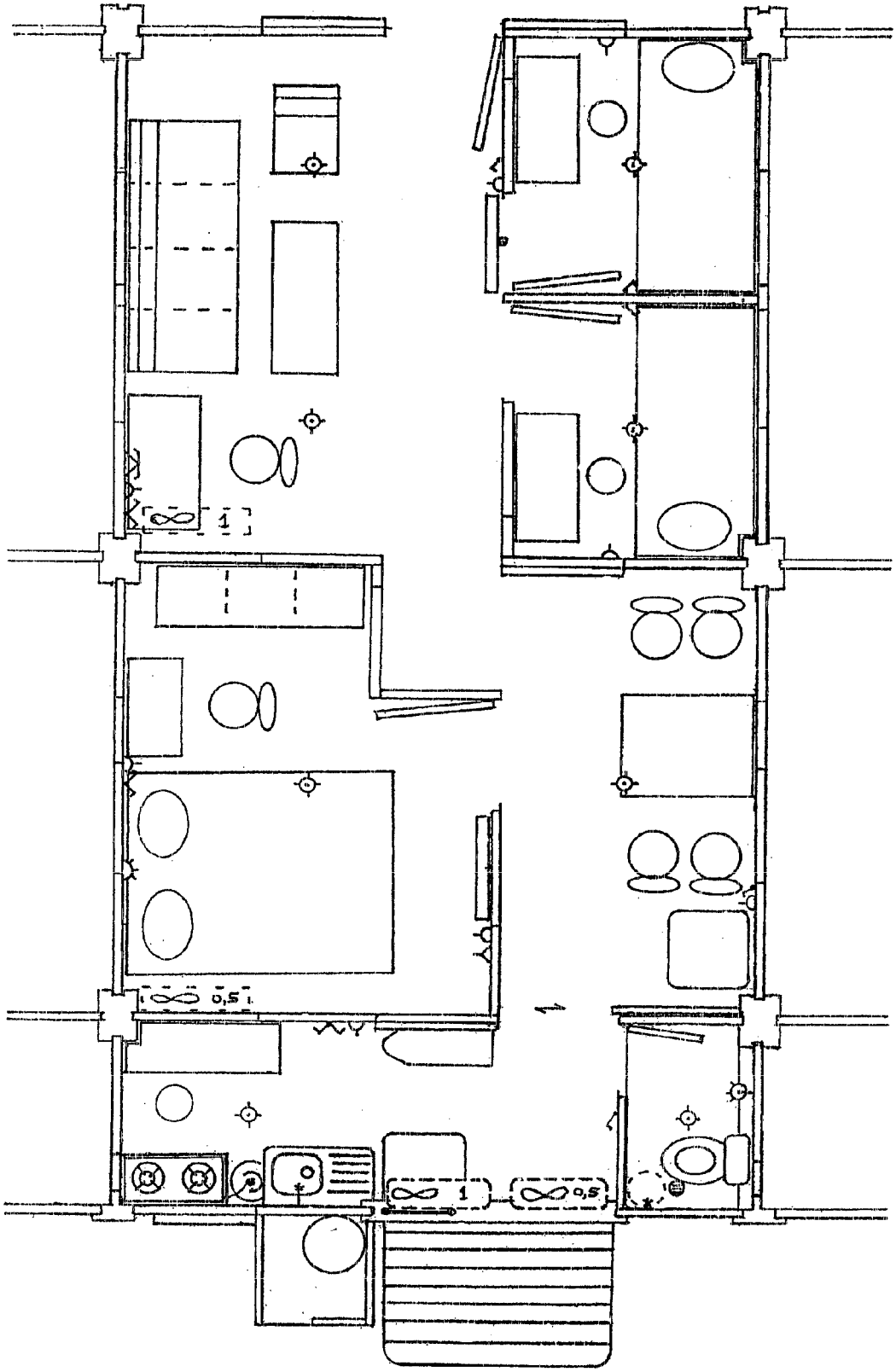
FIG. 8C shows a floor layout of an apartment unit according to an embodiment of this invention.

FIG. 8C shows a floor layout of a housing unit in a multi-story building built with pre-cast concrete components, according to an embodiment of this invention. Each unit uses six columns and has a terrace corridor in front, a master bedroom, two smaller bedrooms, a bathroom, a living room, a dining room, kitchen/laundry room, a clothes drying rack at the rear window that also serve as an emergency ladder, and a garbage chute, according to an embodiment of this invention.

Figure 8D:
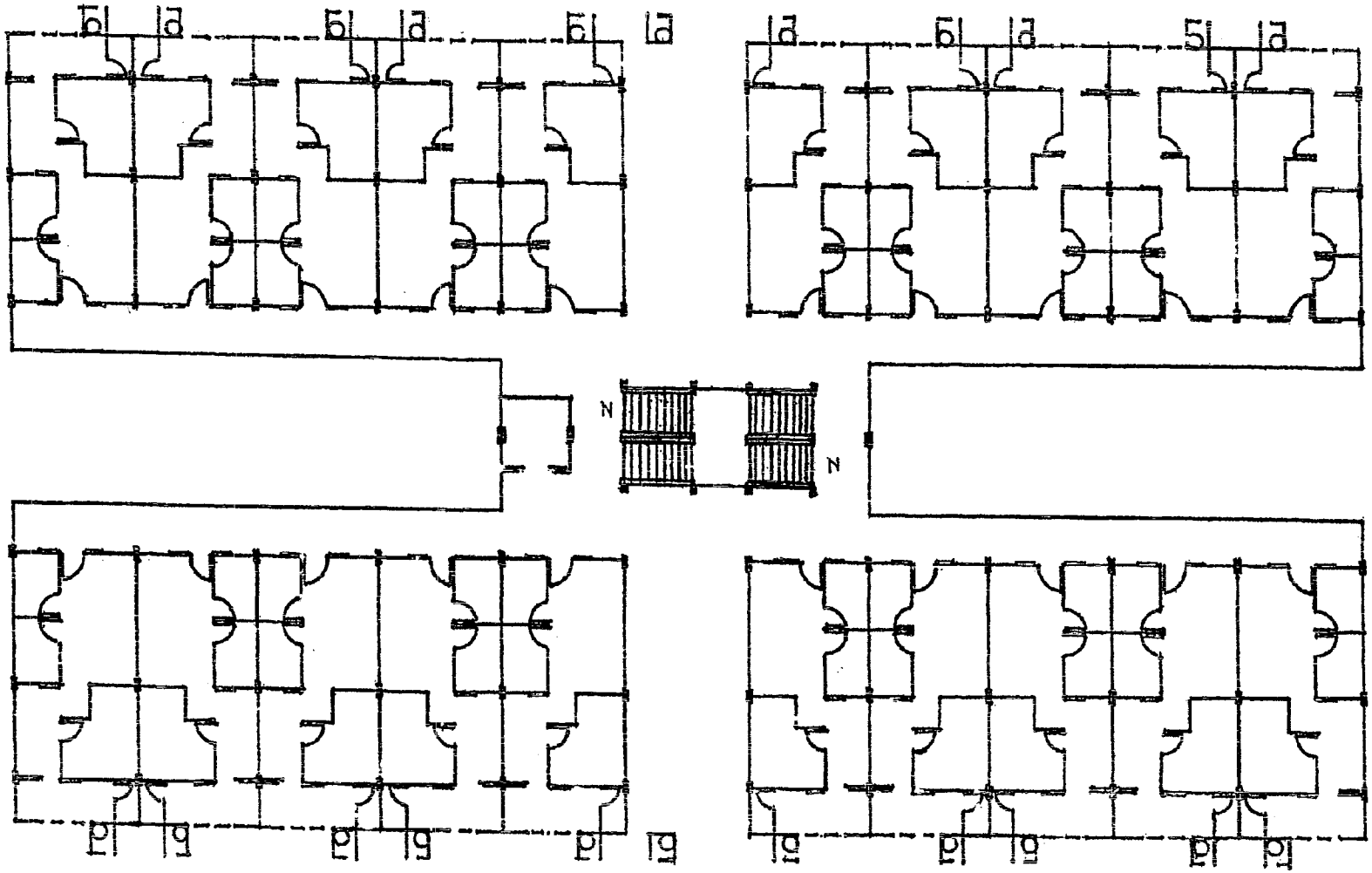
FIG. 8D shows a block site plan for a 120-units six-story apartment building according to an embodiment of this invention.

FIG. 8D shows a block site plan for a 120-unit, six-story apartment building according to an embodiment of this invention, with terrace corridors in front, garbage chutes and garbage bins at the back, stairs, elevator, and some parking space. The roof of the building can be used for a garden or other shared facilities in this invention.

Figure 8F:
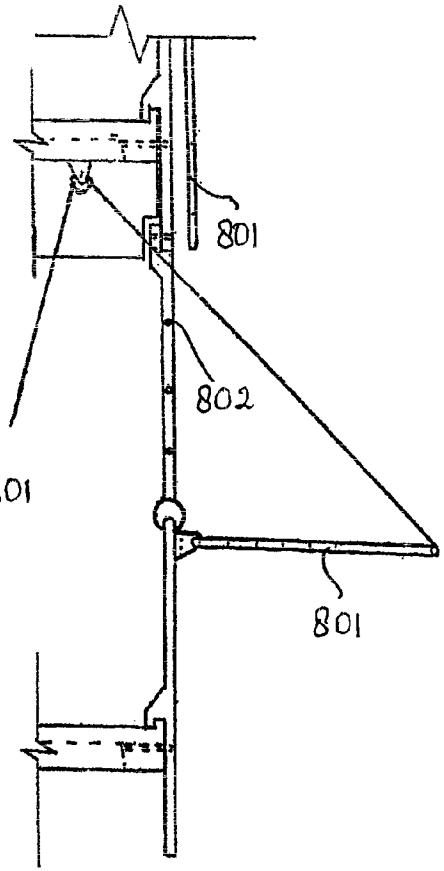
FIG. 8F shows a vertical cross section of the clothes drying rack and window according to an embodiment of this invention.
Figure 8E:
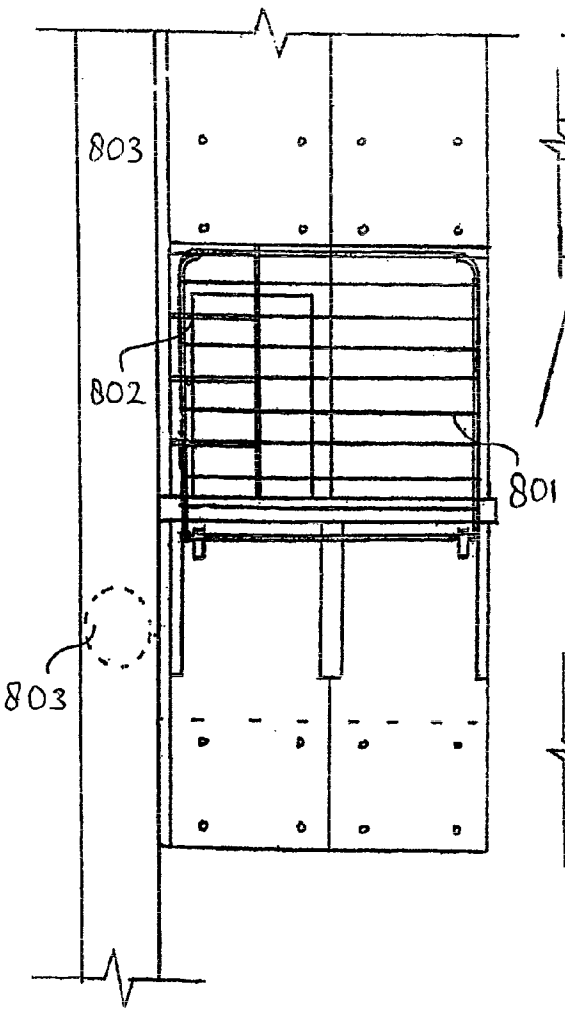
FIG. 8E shows a clothes drying rack outside a window of and according to an embodiment of this invention, the rack also functions as an emergency ladder in case of fire.

FIG. 8E shows a rear view of a window component with a clothes drying rack, showing the rack 801 in a closed position at night, steel ladder 802 and garbage chute 803. FIG. 8F shows a side view of the rack 801 in an open position during the day to dry clothes. If the rack is lowered, combined with the steel ladder 802, it can also function as an emergency ladder.

Figure 9:
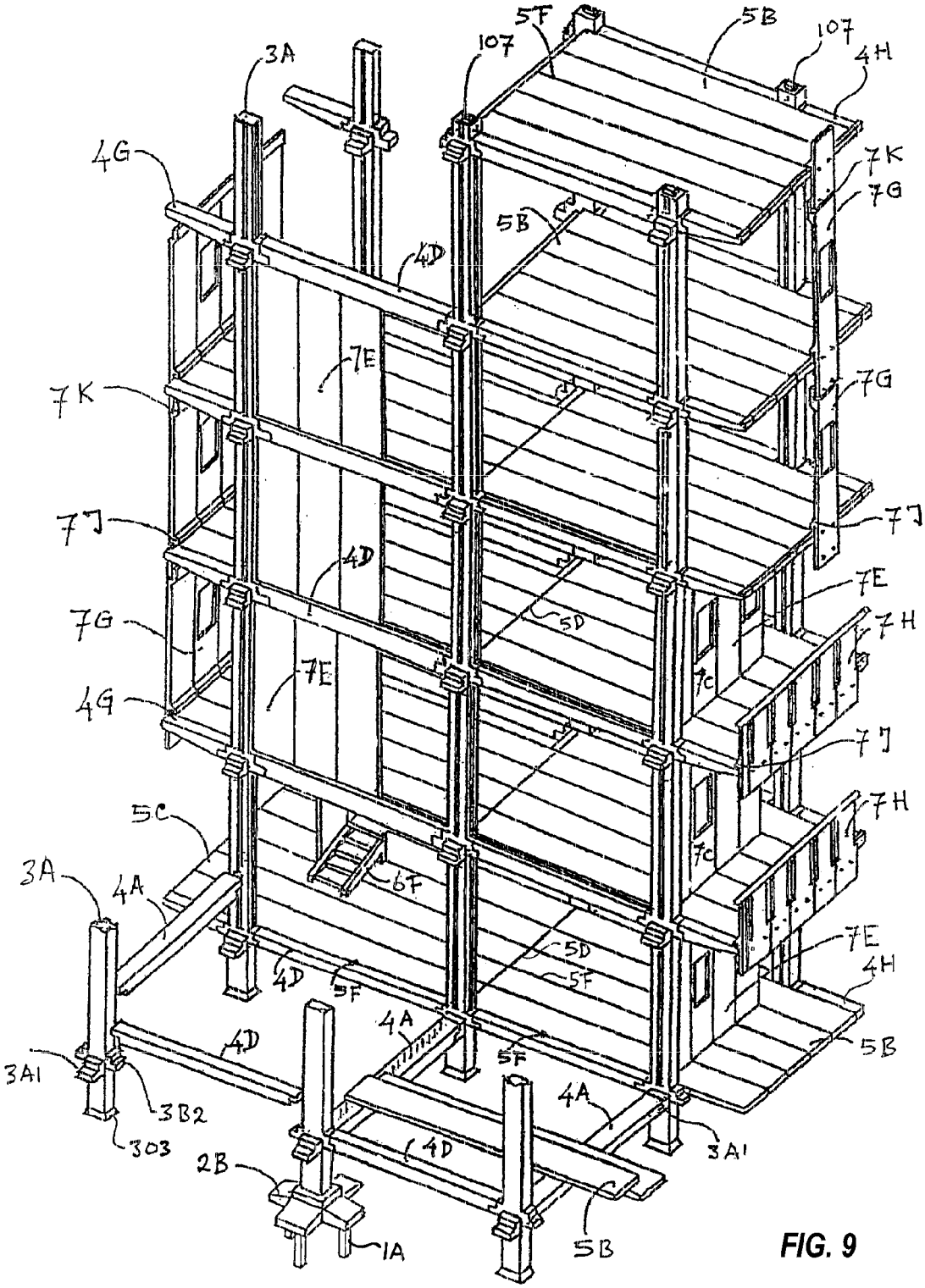
FIG. 9 shows a perspective view of a multi-story building constructed from the pre-cast concrete components of and according to an embodiment of this invention.

FIG. 9 shows a perspective view of a multi-story building using pre-cast concrete components, according to an embodiment of this invention. The building is comprised of: pile foundation 1A, pile caps 2B, columns 3A, beams (4A, 4D, 4G, 4H), floors (5B, 5C), stairs 6F, walls (7A, 7C, 7D, 7E, 7G) and parapet 7H. The building is intended for five floors with possible extension to six floors. FIG. 9 shows the columns 3A with wings (3A1, 3A2, 3B1, 3B2). The bottom end 303 of the column is inserted into the pile cap 2B and grouted in concrete after some vertical and horizontal column alignments. Floor-supporting beams 4A and wall-supporting beams 4D are placed on the column wings (3A1, 3A2, 3B1, 3B2), anchored (not shown), bolted with steel plates (not shown), and then welded (not shown). Floors (5B, 5C) are placed on floor-supporting beams 4A and walls inserted on wall-supporting beams 4D. Floor components 5B have facilities to be joined with other floor components above the beams (as shown in FIG. 5E) and on the sides (as shown in FIG. 5F). After grouting with concrete, these facilities prevent leakage between floors.

Still referring to FIG. 9, the rear outside walls 7G are mounted on beam consoles 4G that are mounted on column wings 3B1 and may also support inside walls. In front, beam consoles 4H are mounted on column wings 3B2 to support the terrace corridor and parapet 7H. Outside walls 7G may have ventilation or windows. The walls 7G are bolted to floor end joints 7J and the walls 7G above. Parapet components 7H are bolted to floor end joints 7J, according to an embodiment of this invention.

Figure 10A:
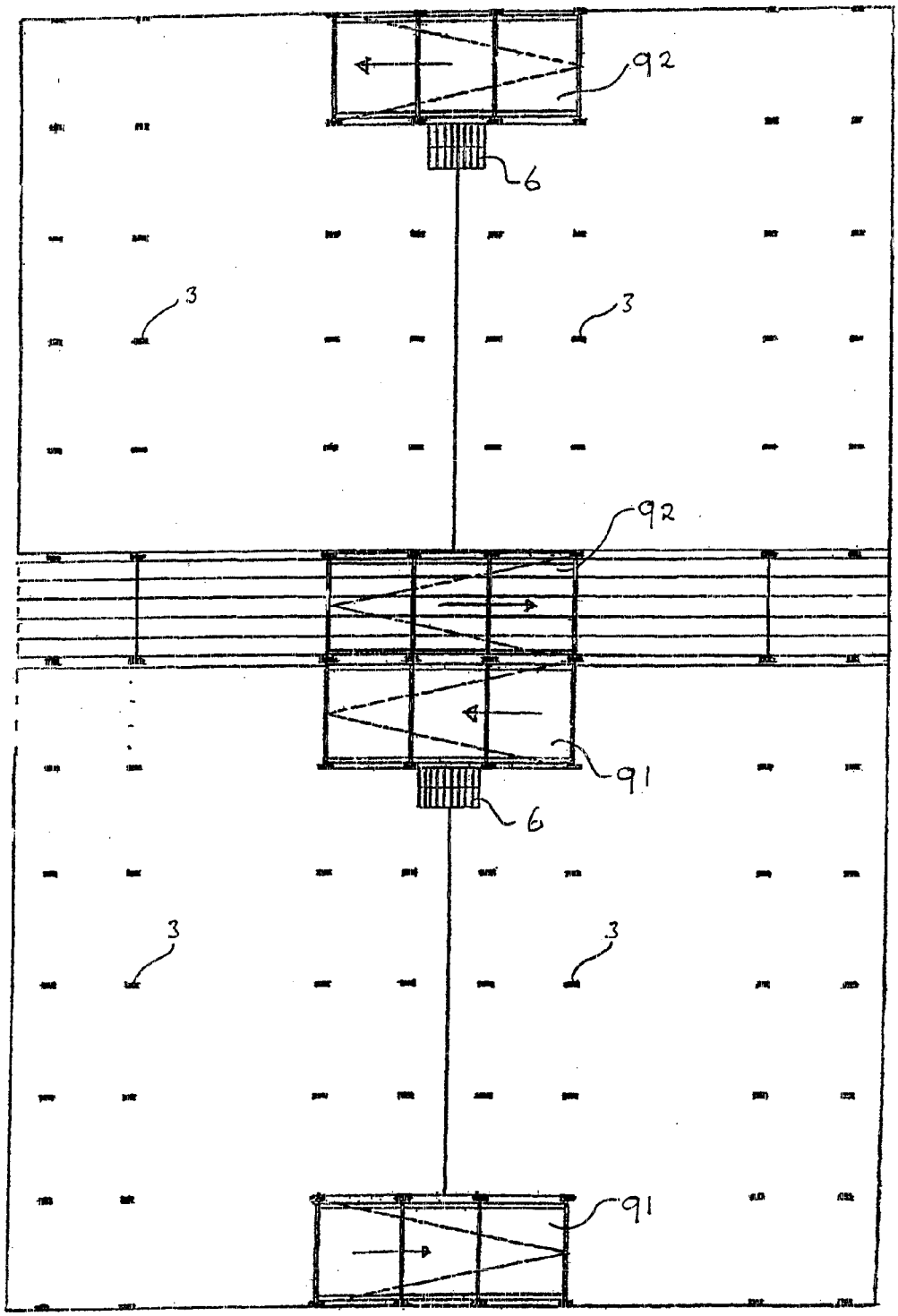
FIG. 10A shows a site plan and design of a multi-story parking garage constructed from the components of and according to an embodiment of this invention.

FIG. 10A shows a site plan for a multi-story parking garage using this invention. The building has columns 3, up 91 and down 92 ramps, and stairs 6 in this invention.

Figure 10B:
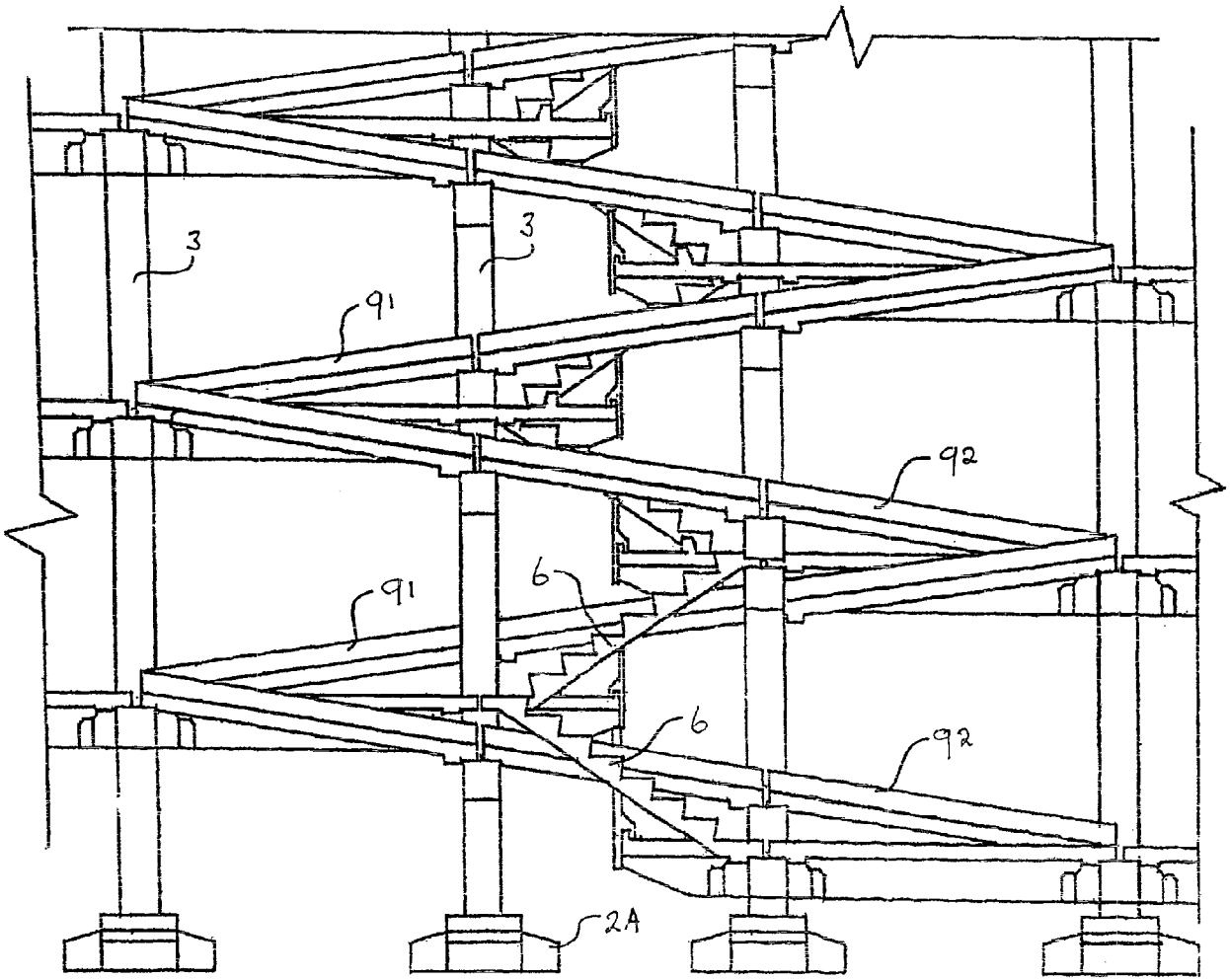
FIG. 10B shows concrete ramp and stairs components in a multi-story parking garage according to an embodiment of this invention.

FIG. 10B shows a vertical cross section of the parking garage on the ramps (91, 92), showing the up 91 and down 92 ramps and stairs 6 in this invention.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments or alternatives of the foregoing description.

I claim:

1. A multi-story building structure made of prefabricated concrete components, comprising:

a pile foundation including a plurality of piles and a plurality of pile caps; a plurality of column components; a plurality of beam components; a plurality of floor components; a plurality of stair components; and a plurality of wall components; wherein each of the plurality of pile caps unites at least two piles to one column component;

each column component having opposing sides and a groove on each opposing side for placement of a corresponding side of a wall component;

each beam component is connected to a column component, each beam component comprising:

a plurality of grooves on a bottom side and a top side of the beam component for placement of a corresponding side of a wall component; and a plurality of holes in a body of each beam component supporting a plumbing and electrical installation;

each of the plurality of floor components tie into a beam component, and are made of concrete that are pre-cast with a predetermined shape, size and strength;

each of the plurality of stair components tie into a beam component, are made of concrete that are pre-cast with predetermined shape, size and strength and assembled to form stairs;

each of the plurality of wall components are attached to a beam component, and are made of concrete that are pre-cast with the a predetermined shape, size and strength;

wherein each column component has four L-shaped column wings to support a plurality of beams on each floor, each wing comprises a top portion and a longer bottom portion stepped out from the top portion;

wherein the longer bottom portion comprises a plurality of right-angle steel plates welded to a plurality of rebar elements reinforcing the column component, and an anchor hole running vertically through a middle of the bottom portion;

the top portion comprises a plurality of right-angle steel plates welded to a plurality of rebar elements reinforcing the column component; and each of the plurality of right-angle steel plates has one or more holes for mounting bolts.

2. A multi-story building structure according to claim 1 wherein the plurality of column components are made of precast concrete with a predetermined shape, size and strength.

3. A multi-story building structure according to claim 2, wherein the plurality of beam components are made of precast concrete with a predetermined shape, size and strength.

4. A multi-story building structure according to claim 2, wherein the plurality of beam components are made of precast concrete with a predetermined shape, size and strength; and each beam component further attached to a column wing of a column component, anchored through the anchor hole.

5. A multi-story building structure according to claim 4, wherein the plurality of beam components comprise floor-supporting beams, and wall-supporting beams having toothed grooves along a side for grouting connection with a floor component.

6. A multi-story building structure according to claim 5, wherein the plurality of floor components further comprise toothed grooves along a side for grouting connection with another floor component or a wall-supporting beam.

7. A multi-story building structure according to claim 1, wherein the plurality of beam components are made of precast concrete with a predetermined shape, size and strength.

8. A multi-story building structure according to claim 1, wherein the plurality of beam components are made of precast concrete with a predetermined shape, size and strength; and each beam component further attached to a column wing of a column component, anchored through the anchor hole.

9. A multi-story building structure according to claim 1, wherein the plurality of wall components comprise inside wall components, each inside wall component comprising a bottom groove along a bottom side for securing to a floor component, a side groove along one side of the wall component, and a side tongue along another side of the wall component which matches in configuration to the side groove.

10. A multi-story building structure according to claim 1, wherein each of the plurality of stair components further comprise:

a first set of stair beams comprising opposing stair beam parts, one stair beam part positioned next to a wall component and the other stair beam part positioned away from the wall component, each stair beam part having a plurality of slots configured to place stair treads;

a second set of stair beams comprising opposing stair beam parts, one stair beam part positioned next to a wall component and the other stair beam part positioned away from the wall component, each stair beam part having a plurality of slots configured to place stair treads;

a stair platform separating the first set and second set of stair beams and placed on a top of stair beam parts; and a plurality of pre-cast stair treads, placed into the slots between the opposing stair beam parts of the first set and second set of stair beams.

11. A multi-story building structure according to claim 1, wherein each of the plurality of stair components further comprise:

a first set of stair beams comprising opposing stair beam parts, one stair beam part positioned next to a wall component and the other stair beam part positioned away from the wall component, each stair beam part having a plurality of slots configured to place stair treads;

a second set of stair beams comprising opposing stair beam parts, one stair beam part positioned next to a wall component and the other stair beam part positioned away from the wall component, each stair beam part having a plurality of slots configured to place stair treads;

a stair platform separating the first set and second set of stair beams and placed on a top of stair beam parts; and a plurality of pre-cast stair treads, placed into the slots between the opposing stair beam parts of the first set and second set of stair beams.

12. A multi-story building structure according to claim 1, wherein the prefabricated concrete components are assembled to form one or more housing units of up to six stories, wherein each housing unit comprises six column components.

13. A multi-story building structure according to claim 1, wherein the prefabricated concrete components are assembled to form a parking garage of up to seven floors.

14. A multi-story building structure made of prefabricated concrete components, comprising:

a plurality of piles;

a plurality of pile caps, cast on top of the piles, each pile cap provided with a depression to seat a column component;

a plurality of column components, each column component seated on a respective depression on a pile cap;

a plurality of lateral and longitudinal beam components, each beam component seated on and bolted to a plurality of column wings;

a plurality of floor components, seated longitudinally on the lateral beam components;

a plurality of stair components, seated on the floor components;

a plurality of wall components, each wall component configured to be seated between a top groove and a bottom groove of each of the beam components, seated in a side groove of each of the column components, or seated on the floor components;

wherein each column component has four L-shaped column wings to support a plurality of beams on each floor, each column wing having a vertical anchor hole in a center of a bottom portion, right-angle steel plates welded to a plurality of rebar elements of said column at a top portion and bottom portion of each column wing, and each of the right-angle steel plates having holes for bolting a steel plate connector;

each beam component having L-shaped ends matching the column wings, each of the L-shaped ends having a top portion longer than a bottom portion, a vertical anchor hole in a center of the top portion, right-angle steel plates welded to a plurality of rebar elements of said beam at the top portion and bottom portion of the ends, and each of the right-angle steel plates having holes for bolting a steel plate connector;

each column component has opposing sides and a groove on each opposing side for placement of wall components;

each lateral beam component has steel stakes on a top of the beam component to tie to a plurality of ends of the floor components, and a groove on the bottom of the beam component for placement of wall components;

each longitudinal beam component has a groove on a top and a groove on a bottom for placement of wall components, and toothed grooves on sides of the top portion for providing leak-proof joints to the floor components;

each floor component having a plurality of steel hooks on at least one end to tie to a lateral beam and to other floor components, and having toothed grooves on sides for providing leak-proof joints to a longitudinal beam and the other floor components.

15. A multi-story building structure according to claim 14, further comprising:

a plurality of longitudinal beam console components, seated on and bolted to the column wings;

a plurality of outside and parapet wall components, seated on and bolted to a tip of the floor components and beam console components; wherein each beam console component is L-shaped on one end matching the column wings, a top portion of the L-shaped end longer than a bottom portion, and having a vertical anchor hole in a center of the top portion, the top portion and bottom portion of the L-shaped end having right-angle steel plates welded to rebar elements of said beam console, and each right-angle steel plates having holes on an end for bolting a steel plate connector;

each beam console component having a protrusion and bolt holes on another end for seating the outside or parapet wall components, and toothed grooves on sides of the top portion for providing leak-proof joints to the floor components;

each of a plurality of rear beam console components has a groove on a top and a groove on a bottom for placement of wall components;

each of a plurality of front and rear floor components spanning a combined length of a longitudinal beam component and a beam console component and having a protrusion and bolt holes on one end for seating the outside or parapet wall components;

each outside wall component having a protrusion on an inside-facing side matching the protrusion on the rear beam console and floor components, corresponding bolt holes, and offset in shape on top to be bolted to a bottom of an outside wall component above;

each parapet wall component having a protrusion on the inside-facing side matching the protrusion on the beam console and floor components, and the corresponding bolt holes.

16. The multi-story building structure according to claim 14, wherein a plurality of column components form a column extension comprising:

a truncated-pyramid-shaped protrusion on a top end of a lower column component;

a matching truncated-pyramid-shaped depression on an bottom end of a column component located above the lower column component, the top end and bottom end opposing each other;

a right-angle steel plate on each corner of the opposing top and bottom ends of the column components that are welded to the rebar elements of said column components; and a plurality of bolt holes on each of said right-angle steel plates for bolting steel plate connectors.

17. The multi-story building structure according to claim 15, wherein a plurality of column components form a column extension comprising:

a truncated-pyramid-shaped protrusion on a top end of a lower column component;

a matching truncated-pyramid-shaped depression on an bottom end of a column component located above the lower column component, the top end and bottom end opposing each other;

a right-angle steel plate on each corner of the opposing top and bottom ends of the column components that are welded to the rebar elements of said column components; and a plurality of bolt holes on each of said right-angle steel plates for bolting steel plate connectors.

* * * * *